US011283158B2

(12) United States Patent
Chen et al.

(10) Patent No.: US 11,283,158 B2
(45) Date of Patent: Mar. 22, 2022

(54) MOBILE DEVICE AND ANTENNA MODULE THEREOF

(71) Applicant: WISTRON NEWEB CORPORATION, Hsinchu (TW)

(72) Inventors: Chung-Hsuan Chen, Hsinchu (TW); Chen-Ming Li, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 40 days.

(21) Appl. No.: 17/013,949

(22) Filed: Sep. 8, 2020

(65) Prior Publication Data

US 2021/0367326 A1 Nov. 25, 2021

(30) Foreign Application Priority Data

May 21, 2020 (TW) ..... 109116968

(51) Int. Cl.

| | |
|---|---|
| ***H01Q 1/24*** | (2006.01) |
| ***H01Q 1/38*** | (2006.01) |
| ***H01Q 1/48*** | (2006.01) |
| ***H01Q 21/28*** | (2006.01) |
| ***H01Q 9/04*** | (2006.01) |

(52) U.S. Cl.

CPC ..... *H01Q 1/243* (2013.01); *H01Q 1/38* (2013.01); *H01Q 1/48* (2013.01); *H01Q 9/0421* (2013.01); *H01Q 21/28* (2013.01)

(58) Field of Classification Search

CPC ..... H01Q 21/28; H01Q 1/38; H01Q 1/48; H01Q 1/243; H01Q 9/0421

See application file for complete search history.

(56) References Cited

U.S. PATENT DOCUMENTS

| | | | | |
|---|---|---|---|---|
| 4,063,246 | A * | 12/1977 | Greiser | H01Q 9/0407 343/700 MS |
| 9,054,422 | B2 | 6/2015 | Tu et al. | |
| 10,826,147 | B2 * | 11/2020 | Sikina | H01P 11/003 |
| 2010/0060535 | A1 * | 3/2010 | Tiezzi | H01Q 5/40 343/770 |

(Continued)

FOREIGN PATENT DOCUMENTS

| | | |
|---|---|---|
| TW | 201424125 A | 6/2014 |
| TW | 201427177 A | 7/2014 |

(Continued)

*Primary Examiner* — Graham P Smith
*Assistant Examiner* — Jae K Kim
(74) *Attorney, Agent, or Firm* — McClure, Qualey & Rodack, LLP

(57) ABSTRACT

A mobile device and an antenna module thereof are provided. The antenna module includes a substrate, a first antenna and a second antenna. The first antenna and the second antenna are disposed on the substrate. The substrate includes a substrate body, a first ground layer and a second ground layer. The first ground layer includes a first slot, the second ground layer includes a second slot, and a vertical projection of the first slot onto substrate body at least partially overlaps with a vertical projection of the second slot onto substrate body. The first slot and the second slot are located between the first antenna and the second antenna, and the first antenna is located closer to the first slot and the second slot than the second antenna.

20 Claims, 15 Drawing Sheets

(56) References Cited

U.S. PATENT DOCUMENTS

| | | | | |
|---|---|---|---|---|
| 2015/0022412 | A1* | 1/2015 | Facco | H01Q 1/48 343/833 |
| 2017/0062932 | A1* | 3/2017 | Foster | H01Q 1/243 |
| 2021/0381290 | A1* | 12/2021 | Wu | E05D 15/0652 |

FOREIGN PATENT DOCUMENTS

| | | | | |
|---|---|---|---|---|
| WO | WO-03103087 | A2 * | 12/2003 | H01Q 21/30 |
| WO | WO-2018089947 | A1 * | 5/2018 | H01Q 5/371 |

* cited by examiner

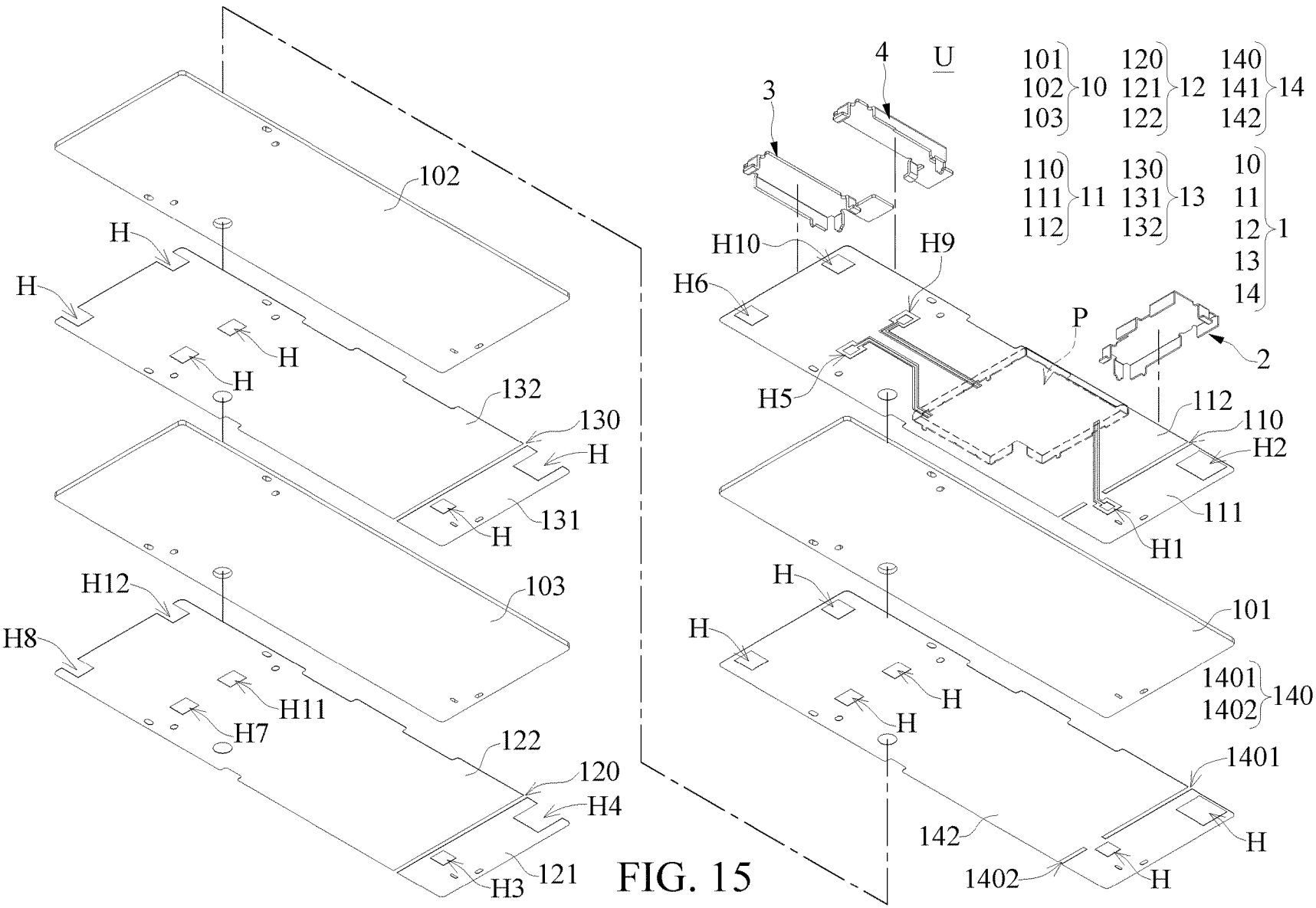
140
141
142
14
10
11
12
13
14
1
120
121
122
12
130
131
132
13
101
102
103
10
110
111
112
11
U
4
3
2
P
H9
H10
H6
H5
112
110
H2
111
H1
101
1401
1402
140
1401
H
H
1402
142
H
H
H

MOBILE DEVICE AND ANTENNA MODULE THEREOF

CROSS-REFERENCE TO RELATED PATENT APPLICATION

This application claims the benefit of priority to Taiwan Patent Application No. 109116968, filed on May 21, 2020. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a mobile device and an antenna module thereof, and more particularly to a mobile device that has at least two antennas and an antenna module thereof.

BACKGROUND OF THE DISCLOSURE

A conventional mobile device generally includes a Bluetooth® antenna and a Wi-Fi antenna to perform Bluetooth® and Wi-Fi functions, respectively. However, the Bluetooth® antenna and the Wi-Fi antenna may easily interfere with each other since their operating frequency bands overlap with each other.

Conventionally, in order to improve the isolation between the Bluetooth® antenna and the Wi-Fi antenna, the Bluetooth® antenna is designed as an external device, so as to be as far away from the Wi-Fi antenna as possible. However, although such a design improves the isolation between the Bluetooth® antenna and the Wi-Fi antenna, the total production cost of the mobile device is thereby increased.

In addition, in the related art, the Bluetooth® antenna and the Wi-Fi antenna may be disposed on a same substrate, and the Bluetooth® antenna is disposed far away from the Wi-Fi antenna in order to improve the isolation between the Bluetooth® antenna and the Wi-Fi antenna. However, such a design leads to an increase in the size of an overall module, and is not applicable to current products that are lighter, thinner, shorter and smaller.

SUMMARY OF THE DISCLOSURE

In response to the above-referenced technical inadequacies, the present disclosure provides a mobile device and an antenna module thereof.

In one aspect, the present disclosure provides an antenna module including a substrate, a first antenna, and a second antenna. The substrate includes a substrate body, a first ground layer and a second ground layer. The substrate body has a first surface and a second surface corresponding to the first surface, the first ground layer is disposed on the first surface, the second ground layer is disposed on the second surface, and the first ground layer is electrically connected to the second ground layer. The first ground layer includes a first slot, the second ground layer includes a second slot, and a vertical projection of the first slot onto the substrate body at least partially overlaps with a vertical projection of the second slot onto the substrate body. The first antenna is disposed on the substrate. The second antenna is disposed on the substrate. The first slot and the second slot are located between the first antenna and the second antenna, and the first antenna is located closer to the first slot and the second slot than the second antenna.

In another aspect, the present disclosure provides a mobile device including a circuit board, an antenna module, a conductive metal sheet, and a conductive fixing element. The antenna module is electrically connected to the circuit board. The antenna module includes a substrate, a first antenna and a second antenna. The substrate includes a substrate body, a first ground layer, a second ground layer and a fixing hole. The substrate body has a first surface and a second surface corresponding to the first surface, the first ground layer is disposed on the first surface, the second ground layer is disposed on the second surface, and the first ground layer is electrically connected to the second ground layer. The fixing hole penetrates the substrate body, the first ground layer and the second ground layer. The first ground layer includes a first slot, the second ground layer includes a second slot, and a vertical projection of the first slot onto the substrate body at least partially overlaps with a vertical projection of the second slot onto the substrate body. The first antenna and the second antenna are disposed on the substrate, the first slot and the second slot are located between the first antenna and the second antenna, and the first antenna is located closer to the first slot and the second slot than the second antenna. The conductive metal sheet includes a positioning hole corresponding to the fixing hole. The conductive fixing element passes through the fixing hole and is fixed within the positioning hole, and the conductive fixing element is electrically connected to the first ground layer and the conductive metal sheet.

Therefore, by virtue of "the vertical projection of the first slot onto the substrate body at least partially overlapping with the vertical projection of the second slot onto the substrate body 10", "the first slot and the second slot being located between the first antenna and the second antenna, and the first antenna being located closer to first slot 110 and the second slot 120 than the second antenna", "the vertical projection of the first body onto the substrate body 10 at least partially overlapping with the vertical projection of the first ground portion 111 onto the substrate body 10", and "the vertical projection of the second body 31 onto the substrate body at least partially overlapping with the vertical projection of the second ground portion onto the substrate body 10", the isolation between the first antenna and the second antenna may be improved, the antenna module of the present disclosure is able to be fixed with the conductive metal sheet by the fixing hole and conductive fixing element, and the first antenna and the second antenna are able to operate normally and keep performance at a certain level when the antenna module U is disposed on the conductive metal sheet.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

FIG. 15 illustrates another isometric view of the antenna module that is disassembled according to the second embodiment of the present disclosure.

DETAILED DESCRIPTION OF THE EXEMPLARY EMBODIMENTS

Figure 1:
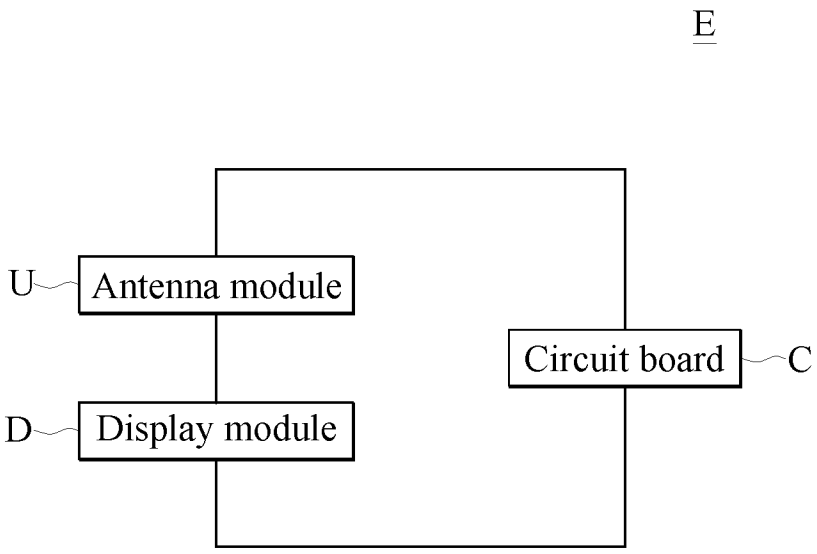
FIG. 1 is a functional block diagram of a mobile device according to a first embodiment of the present disclosure.
Figure 2:
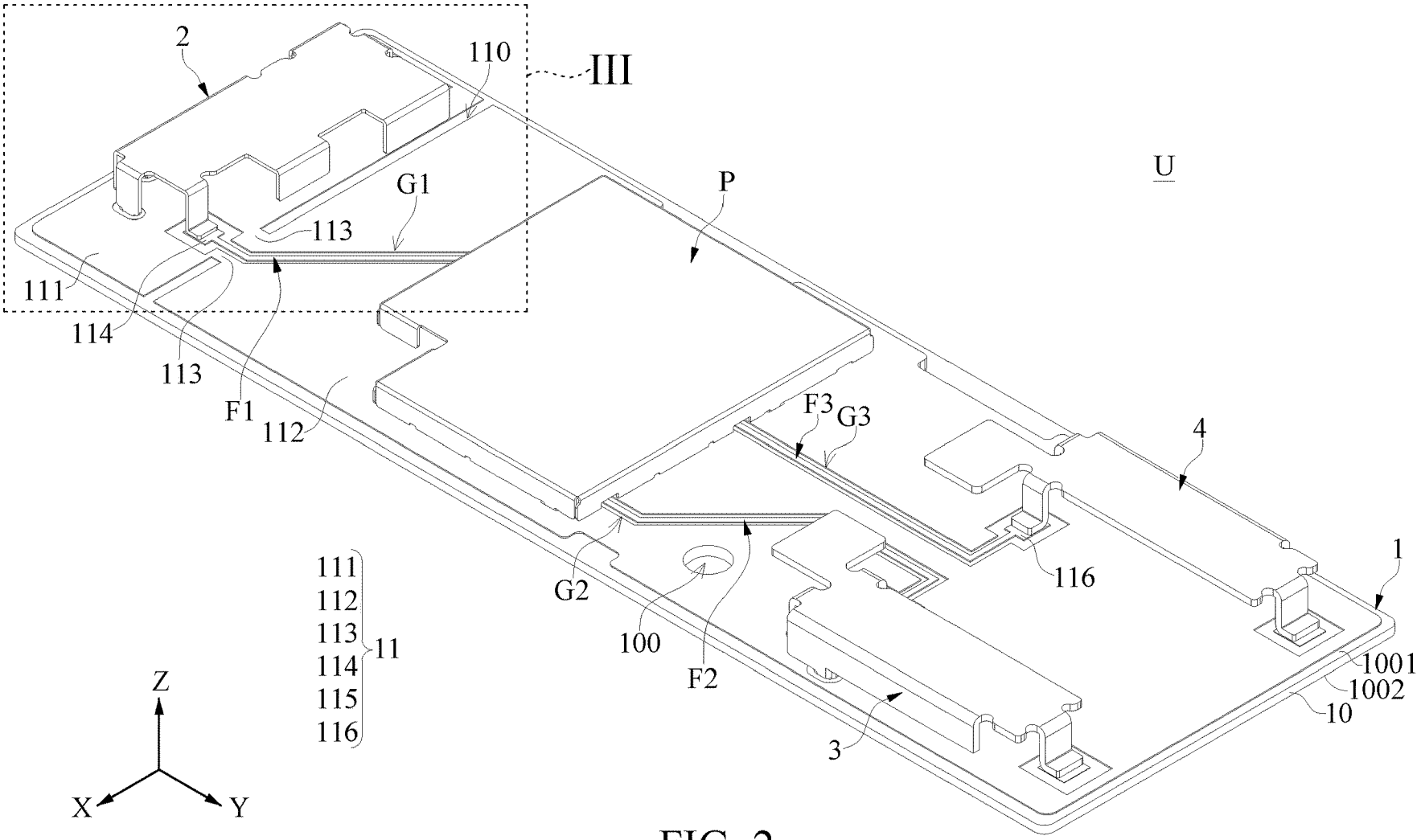
FIG. 2 illustrates an isometric view of an antenna module that is assembled according to the first embodiment of the present disclosure.
Figure 3:
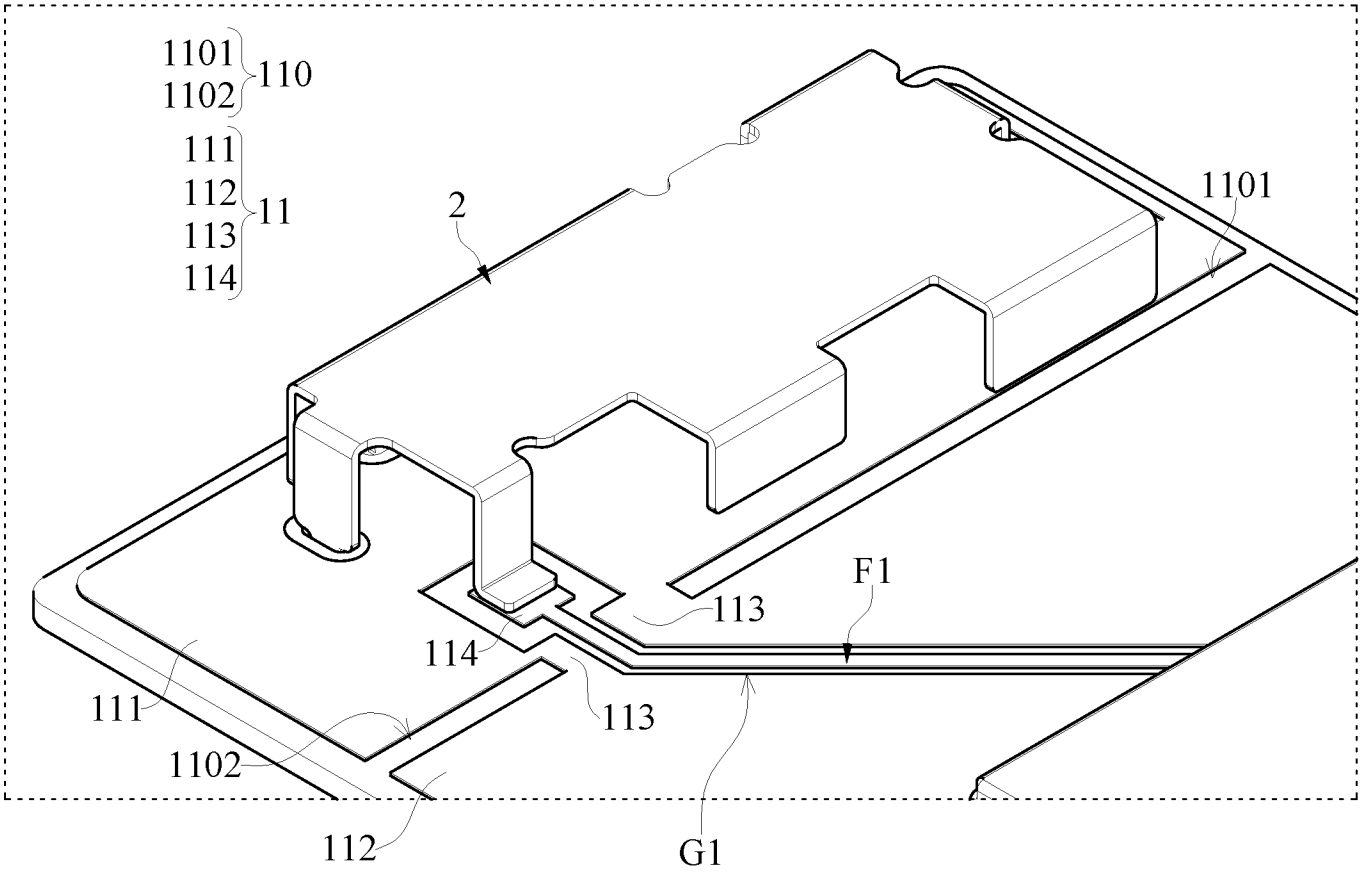
FIG. 3 is a schematic enlarged view of section III in FIG. 2.
Figure 4:
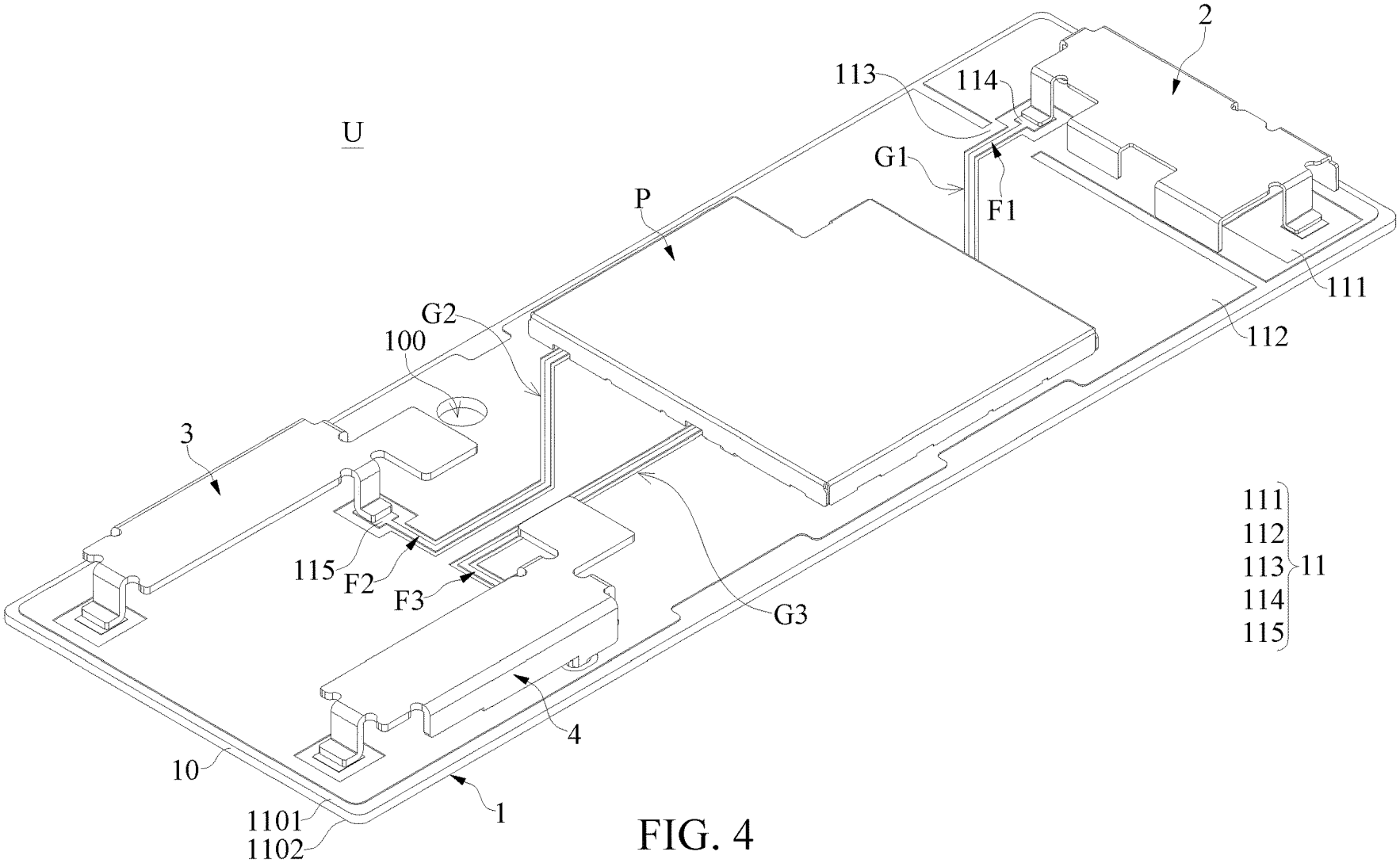
FIG. 4 illustrates another isometric view of the antenna module that is assembled according to the first embodiment of the present disclosure.
Figure 5:
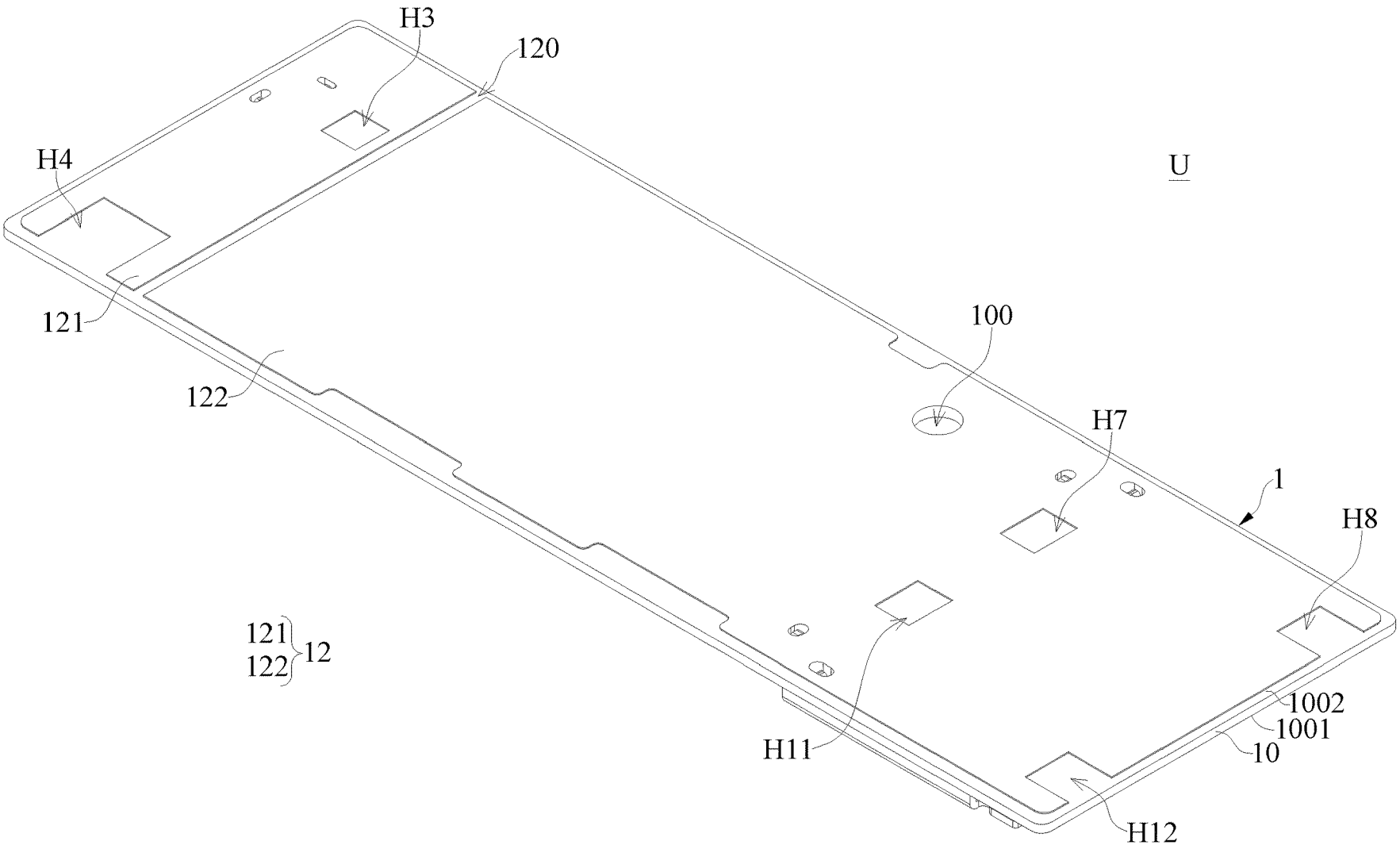
FIG. 5 illustrates another isometric view of the antenna module that is assembled according to the first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Referring to FIG. 1, the present disclosure provides a mobile device E and an antenna module U thereof, and the mobile device E includes a circuit board C, an antenna module U and a display module D. In one embodiment, the mobile device E may be a display device or a smart television, the circuit board C may control the antenna module U to transmit and receive signals, and the display module D is used for displaying image information. However, it should be noted that the mobile device E can be provided without including the display module D in the present disclosure.

Referring to FIG. 2 to FIG. 5, the antenna module U includes a substrate 1, a first antenna 2 and a second antenna 3, and the first antenna 2 and the second antenna 3 are each disposed on the substrate 1. In addition, the antenna module U further includes a signal processing circuit P, a first feeding element F1 and a second feeding element F2, and the signal processing circuit P, the first feeding element F1 and the second feeding element F2 are disposed on the substrate 1. The first antenna 2 is electrically connected to the signal processing circuit P, the second antenna 3 is electrically connected to the signal processing circuit P, the first feeding element F1 is electrically connected between the first antenna 2 and the signal processing circuit P, and the second feeding element F2 is electrically connected between the second antenna 3 and the signal processing circuit P. Preferably, the antenna module U further includes a third antenna 4 and a third feeding element F3, and the third antenna 4 and the third feeding element F3 are disposed on the substrate 1. In addition, the third antenna 4 is electrically connected to the signal processing circuit P, and the third feeding element F3 is electrically connected between the third antenna 4 and the signal processing circuit P. Furthermore, it is worth noting that in the present disclosure, the first antenna 2, the second antenna 3 and the third antenna 4 are each disposed on the substrate 1, which indicates that the first antenna 2 and the second antenna 3 are disposed on the same substrate 1.

The substrate 1 includes a substrate body 10, a first ground layer 11 and a second ground layer 12, and the substrate body 10 includes a first surface 1001 and a second surface 1002 corresponding to the first surface 1001. The first ground layer 11 is disposed on the first surface 1001, the second ground layer 12 is disposed on second surface 1002, and the first ground layer 11 is electrically connected to the second ground layer 12. For example, in one embodiment, the first ground layer 11 and the second ground layer 12 may be electrically connected by a via hole (not shown in FIG. 2) coated with a conductor and formed in the substrate body 10, which is not limited in the present disclosure.

Referring to FIG. 2 to FIG. 5, in detail, the first ground layer 11 includes a first slot 110, the second ground layer 12 includes a second slot 120, and a vertical projection of the first slot 110 onto the substrate body 10 at least partially overlaps with a vertical projection of the second slot 120 onto the substrate body 10. In other words, the vertical projections of the first slot 110 and the second slot 120 onto the substrate body 10 may form a clear section on the substrate 1. In addition, in the present disclosure, the first slot 110 and the second slot 120 are located between the first antenna 2 and the second antenna 3, and the first antenna 2 is located closer to the first slot 110 and second slot 120 than the second antenna 3. In addition, it is worth noting that, when the antenna module U further includes a third antenna 4, the first slot 110 and the second slot 120 are located between the first antenna 2 and the third antenna 4, and the first antenna 2 is located closer to the first slot 110 and second slot 120 than the third antenna 4. With this structure, the radiation efficiencies of the second antenna 3 and the third antenna 4 may be improved when the first slot 110 and the second slot 120 are located closely to the first antenna 2.

For example, in the present disclosure, the first antenna 2 may be a Bluetooth® antenna, at least one of the second antenna 3 and the third antenna 4 may be a Wi-Fi antenna, the first antenna 2 may operate in an operating frequency band having a frequency range from 2.4 GHz to 2.5 GHz, and at least one of the second antenna 3 and the third antenna 4 may operate in another operating frequency band having a frequency range from 2.4 GHz to 2.5 GHz, which is not limited in the present disclosure. In other words, the antenna module U provided in the present disclosure is applicable to the mobile device E that needs to simultaneously transmit and receive Bluetooth® and Wi-Fi signals with similar operating frequency bands. At the same time, the isolation between the first antenna 2 and the second antenna 3 may be improved by forming the first slot 110 and the second slot 120, and the first antenna 2 and the second antenna 3 are prevented from interfering with each other. In addition, it is worth mentioning that in one embodiment, at least one of the second antenna 3 and the third antenna 4 may operate in another operating frequency band having a frequency range from 5 GHz to 6 GHz, which is not limited in the present disclosure.

Figure 6:
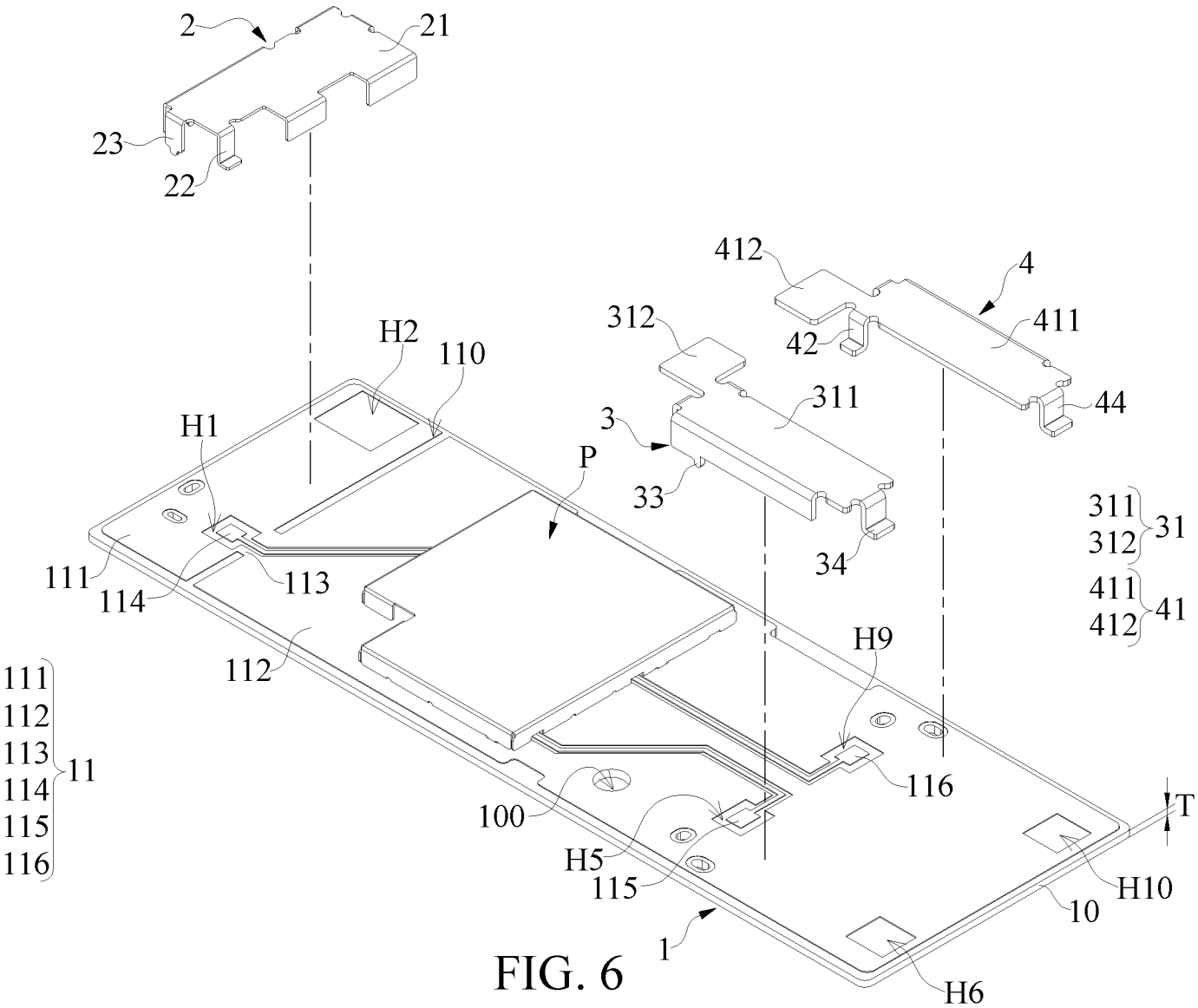
FIG. 6 illustrates an isometric view of the antenna module that is disassembled according to the first embodiment of the present disclosure.
Figure 7:
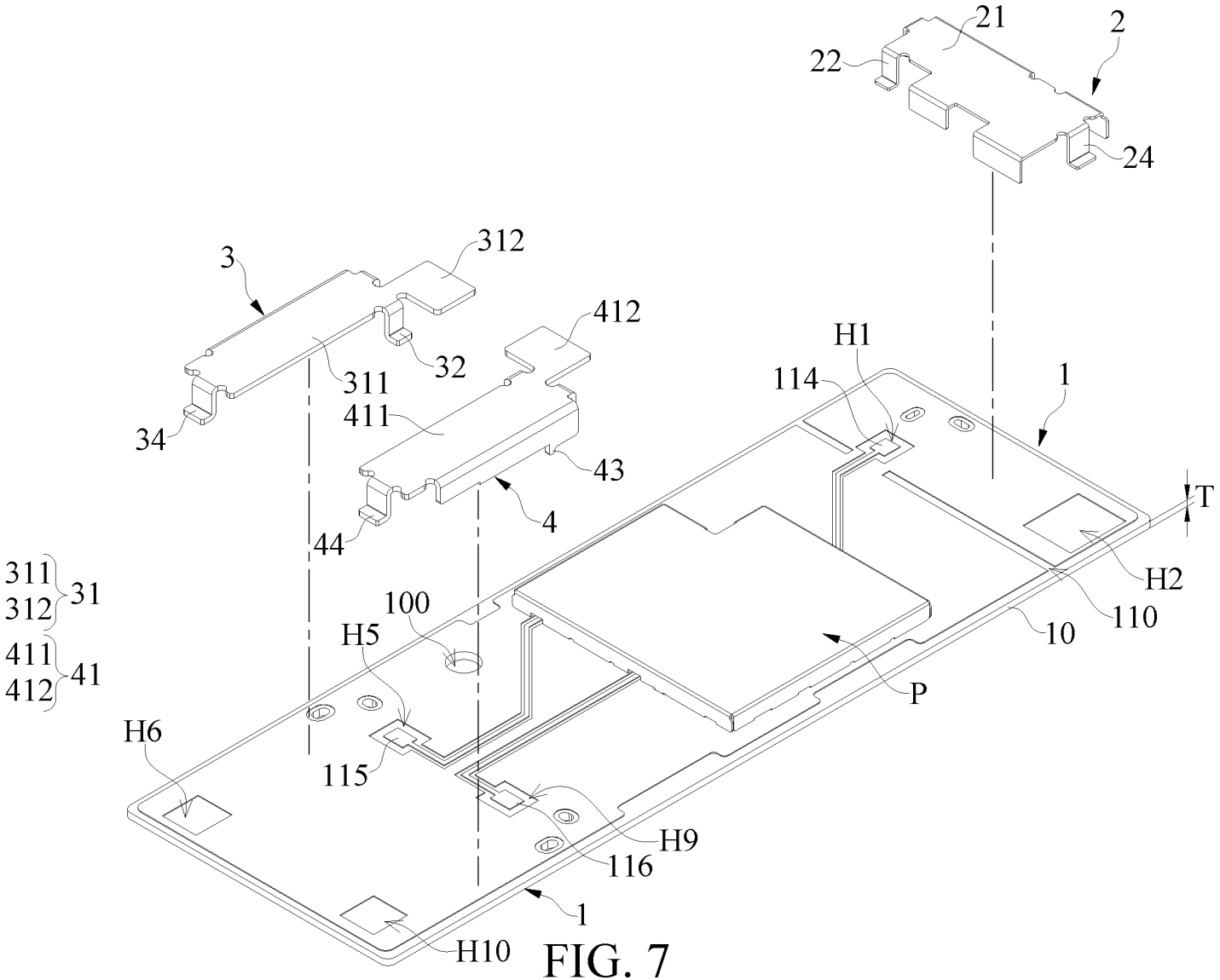
FIG. 7 illustrates another isometric view of the antenna module that is disassembled according to the first embodiment of the present disclosure.

Referring to FIG. 2 to FIG. 5, which are to be read in conjunction with FIG. 6 and FIG. 7, the first ground layer 11 further includes a first ground portion 111 and a second ground portion 112, and the first slot 110 is located between the first ground portion 111 and the second ground portion 112. The second ground layer 12 further includes a third ground portion 121 and a fourth ground portion 122, the second slot 120 is located between the third ground portion 121 and the fourth ground portion 122, and the third ground portion 121 and the fourth ground portion 122 are completely separated by the second slot 120, such that the third ground portion 121 is completely separated from the fourth ground portion 122. In addition, in one embodiment, the substrate 1 may be an FR4 (Flame Retardant 4) substrate, a PCB (Printed Circuit Board) or an FPCB (Flexible Printed Circuit Board). The first ground layer 11 and the second ground layer 12 may be respectively disposed on two copper foils that are formed on two surfaces of the substrate body 10 that are opposite to each other. The first slot 110 and the second slot 120 are formed on the copper foil to expose certain sections of the first surface 1001 and the second surface 1002 of the substrate body 10, and the certain sections that are exposed are non-conductive.

A vertical projection of the first ground portion 111 onto the substrate body 10 at least partially overlaps with a vertical projection of the third ground portion 121 onto the substrate body 10, and a vertical projection of the second ground portion 112 onto the substrate body 10 at least partially overlaps with a vertical projection of the fourth ground portion 122 onto the substrate body 10. In addition, the first ground portion 111 and the third ground portion 121 may be electrically connected by a via hole (FIG. 2) coated with a conductor and formed in the substrate body 10, and the second ground portion 112 and the fourth ground portion 122 may be electrically connected by another via hole (FIG. 2) coated with a conductor and formed in substrate body 10.

The first ground layer 11 further includes a connecting portion 113 disposed on the first surface 1001 of the substrate body 10, and the connecting portion 113 is electrically connected between the first ground portion 111 and the second ground portion 112. In other words, the connecting portion 113 divides the first slot 110 into a first slot section 1101 and a second slot section 1102, i.e., the connecting portion 113 is disposed between the first slot section 1101 and the second slot section 1102. In addition, in the present disclosure, a vertical projection of the connecting portion 113 onto the substrate body 10 at least partially overlaps with a vertical projection of the second slot 120 onto the substrate body 10; preferably, the vertical projection of the connecting portion 113 onto the substrate body 10 completely overlaps with the vertical projection of the second slot 120 onto the substrate body 10. However, it should be noted that in other embodiments, the first ground layer 11 including the connecting portion 113 may be provided without dividing the first slot 110 apart. That is to say, the connecting portion 113 may be disposed on an edge of the first slot 110, so that the first slot 110 will not be divided into a plurality of slot sections. In addition, it should be noted that in the first embodiment, the second ground layer 12 does not include a connecting portion connected between the third ground portion 121 and the fourth ground portion 122. With this structure, in the present disclosure, vertical projections of the first slot section 1101 and the second slot section 1102 of the first slot 110 onto the substrate body 10 completely overlap with a vertical projection the second slot 120 onto the substrate body 10.

For example, in the present disclosure, the first ground layer 11 further includes a first groove G1, a second groove G2 and a third groove G3. The first feeding element F1, the second feeding element F2 and the third feeding element F3 may be respectively formed in the first groove G1, the second groove G2 and the third groove G3, such that the first feeding element F1, the second feeding element F2 and the third feeding element F3 are separated from the first ground layer 11. In other words, the first feeding element F1, the second feeding element F2 the third feeding element F3, and the first ground layer 11 are simultaneously formed by performing a printed circuit board process and are separated by the first groove G1, the second groove G2 and the third groove G3 from the first ground layer 11 by performing an etching process during the printed circuit board process. In addition, it should be noted that the signal processing circuit P is disposed on the second ground portion 112 of the first ground layer 11, and the first antenna 2 is disposed on first ground portion 111. With this structure, the first groove G1 extends from the second ground portion 112 to the connecting portion 113, in order to electrically connect the first feeding element F1 disposed in the first groove G1 to the first antenna 2.

Referring to FIG. 6 and FIG. 7, the first antenna 2 includes a first body 21, a first conductive feeding portion 22 electrically connected to the first body 21, and a first conductive grounding portion 23 electrically connected between the first body 21 and the first ground layer 11. The second antenna 3 includes a second body 31, a second conductive feeding portion 32 electrically connected to the second body 31, and a second conductive grounding portion 33 electrically connected between the second body 31 and the first ground layer 11. The third antenna 4 includes a third body 41, a third conductive feeding portion 42 electrically connected to the third body 41, and a third conductive grounding portion 43 electrically connected between the third body 41 and the first ground layer 11. In addition, the first feeding element F1 is electrically connected between the first conductive feeding portion 22 of the first antenna 2 and the signal processing circuit P, the second feeding element F2 is electrically connected between the second conductive feeding portion 32 of the second antenna 3 and the signal processing circuit P, and the third feeding element F3 is electrically connected between the third conductive feeding portion 42 of the third antenna 4 and the signal processing circuit P. In addition, for example, the first conductive grounding portion 23, the second conductive grounding portion 33 and the third conductive grounding portion 43 may be soldered on the first ground layer 11 of the substrate 1, and be electrically connected to the first ground layer 11. In one embodiment, a plurality of through holes (not labeled in FIG. 6) may be formed in the substrate 1. The plurality of through holes correspond to the first conductive grounding portion 23, the second conductive grounding portion 33 and the third conductive grounding portion 43, respectively, such that a plurality of terminals of the first conductive grounding portion 23, the second conductive grounding portion 33 and the third conductive grounding portion 43 may be respectively inserted into the plurality of through holes, in order to firmly fix the first antenna 2, the second antenna 3 and the third antenna 4. In addition, for example, in the present disclosure, at least one of the first antenna 2, the second antenna 3 and third antenna 4 may be a metal-type antenna, and at least one of the first antenna 2, the second antenna 3 and the third antenna 4 may be a PIFA (Planar inverted-F antenna). However, it should be noted that the antenna type of the first antenna 2, the second antenna 3 and the third antenna 4 is not limited in the present disclosure.

It is worth mentioning that in one embodiment, at least one of the second antenna 3 and the third antenna 4 may operate in an operating frequency band having a frequency range from 2.4 GHz to 2.5 GHz and another operating frequency band having a frequency range 5 GHz to 6 GHz. Therefore, the second body 31 of the second antenna 3 includes a low frequency band radiating portion 311 configured to operate in the operating frequency band having the frequency range from 2.4 GHz to 2.5 GHz and a high frequency band radiating portion 312 configured to operate in the operating frequency band having the frequency range from 5 GHz to 6 GHz, and the third body 41 of the third antenna 4 includes a low frequency band radiating portion 411 configured to operate in the operating frequency band having the frequency range from 2.4 GHz to 2.5 GHz and a high frequency band radiating portion 412 configured to operate in the operating frequency band having the frequency range from 5 GHz to 6 GHz.

The first antenna 2 further includes a first support portion 24 abutting against the substrate body 10, the second antenna 3 further includes a second support portion 34 abutting against the substrate body, the third antenna 4 further includes a third support portion 44 abutting against the substrate body 10, such that the first support portion 24, the second support portion 34 and the third support portion 44 are configured to respectively prevent the first antenna 2, the second antenna 3 and the third antenna 4 from moving relative to the substrate 1.

In the present disclosure, the first ground layer 11 further includes a first hollow section H1 corresponding to the first conductive feeding portion 22 and a second hollow section H2 corresponding to the first support portion 24, and the second ground layer 12 further includes a third hollow section H3 corresponding to the first conductive feeding portion 22 and a fourth hollow section H4 corresponding to the first support portion 24. A vertical projection of the first hollow section H1 onto the substrate body 10 at least partially overlaps with a vertical projection of the third hollow section H3 onto the substrate body 10, and a vertical projection of the second hollow section H2 onto the substrate body 10 at least partially overlaps with a vertical projection of the fourth hollow section H4 onto the substrate body 10. In other words, the vertical projections of the first hollow section H1 and the third hollow section H3 onto the substrate body 10 may form a clear section on the substrate 1, and the vertical projections of the second hollow section H2 and the fourth hollow section H4 onto the substrate body 10 may form another clear section on the substrate 1. However, it should be noted that in one embodiment, the first ground layer 11 further includes a first conductive feeding portion 114, and the first conductive feeding portion 114 is disposed in the first hollow section H1 and electrically connected to the first conductive feeding portion 22. In addition, the first conductive feeding portion 22 abuts against the first conductive feeding portion 114, and the first feeding element F1 is electrically connected to first conductive feeding portion 22 through the first conductive feeding portion 114.

Moreover, the first ground layer 11 further includes a fifth hollow section H5 corresponding to the second conductive feeding portion 32 and a sixth hollow section H6 corresponding to the second support portion 34, and the second ground layer 12 further includes a seventh hollow section H7 corresponding to the second conductive feeding portion 32 and an eighth hollow section H8 corresponding to the second support portion 34. A vertical projection of the fifth hollow section H5 onto the substrate body 10 at least partially overlaps with a vertical projection of the seventh hollow section H7 onto the substrate body 10, and a vertical projection of the sixth hollow section H6 onto the substrate body 10 at least partially overlaps with a vertical projection of the eighth hollow section H8 onto the substrate body 10. In other words, the vertical projections of the fifth hollow section H5 and the seventh hollow section H7 onto the substrate body 10 may form a clear section on the substrate 1, and the vertical projections of the sixth hollow section H6 and the eighth hollow section H8 onto the substrate body 10 may form another clear section on the substrate 1. However, it should be noted that in one embodiment, the first ground layer 11 further includes a second conductive feeding portion 115, and the second conductive feeding portion 115 is disposed in the fifth hollow section H5 and electrically connected to the second conductive feeding portion 32. In addition, the second conductive feeding portion 32 abuts against the second conductive feeding portion 115, and the second feeding element F2 is electrically connected to second conductive feeding portion 32 through the second conductive feeding portion 115.

The first ground layer 11 further includes a ninth hollow section H9 corresponding to the third conductive feeding portion 42 and a tenth hollow section H10 corresponding to the third support portion 44, and the second ground layer 12 further includes an eleventh hollow section H11 corresponding to the third conductive feeding portion 42 and a twelfth hollow section H12 corresponding to the third support portion 44. A vertical projection of the ninth hollow section H9 onto the substrate body 10 at least partially overlaps with a vertical projection of the eleventh hollow section H11 onto the substrate body 10, and a vertical projection of the tenth hollow section H10 onto the substrate body 10 at least partially overlaps with a vertical projection of the twelfth hollow section H12 onto the substrate body 10. In other words, the vertical projections of the ninth hollow section H9 and the eleventh hollow section H11 onto the substrate body 10 may form a clear section on the substrate 1, and the vertical projections of the tenth hollow section H10 and the twelfth hollow section H12 onto the substrate body 10 may form another clear section on the substrate 1. However, it should be noted that in one embodiment, the first ground layer 11 further includes a third conductive feeding portion 116, and the third conductive feeding portion 116 is disposed in the ninth hollow section H9 and electrically connected to the third conductive feeding portion 42. In addition, the third conductive feeding portion 42 abuts against the third conductive feeding portion 116, and the third feeding element F3 is electrically connected to the third conductive feeding portion 42 through the third conductive feeding portion 116.

It should be noted that, the present disclosure is exemplified by the first slot 110 and the second slot 120 being disposed adjacent to the first antenna 2, and the abovementioned term "adjacent" may indicate that a gap between the vertical projection of the first antenna 2 onto the substrate body 10 and at least one of the vertical projections of the first slot 110 and the second slot 120 onto the substrate body 10 is smaller than a certain distance (for example, but not limited to, a distance of 5 millimeters or shorter). In the present disclosure, the present disclosure is provided with the gap between the vertical projection of the first conductive feeding portion 114 of the first antenna 2 onto the substrate body 10 and at least one of the vertical projections of the first slot 110 and the second slot 120 onto the substrate body 10 being smaller than a certain distance. With this structure, the radiation efficiencies of the second antenna 3 and the third antenna 4 are improved by disposing the first slot 110 and the second slot 120 adjacent to the first antenna 2.

Referring to FIG. 6 and FIG. 7, the vertical projection of the first antenna 2 onto the substrate body 10 at least partially overlaps with the vertical projection of the first ground portion 111 onto the substrate body 10, and the vertical projection of the second antenna 3 onto the substrate body 10 at least partially overlaps with the vertical projection of the second ground portion 112 onto the substrate body 10. In detail, in the present disclosure, a vertical projection of the first body 21 onto the substrate body 10 at least partially overlaps with a vertical projection of the first ground portion 111 onto the substrate body 10, and a vertical projection of the second body 31 onto the substrate body 10 at least partially overlap with a vertical projection of the second ground portion 112 onto the substrate body 10. In other words, the first body 21 of the first antenna 2 and the second body 31 of the second antenna 3 of the antenna module U provided in the embodiment of the present disclosure may be disposed on a non-clear section of the substrate 1. With this structure, the antenna module U provided in the present disclosure is able to operate normally and keep its performance at a certain level when the antenna module U is disposed on a metal part (e.g., a conductive metal sheet M).

Figure 8:
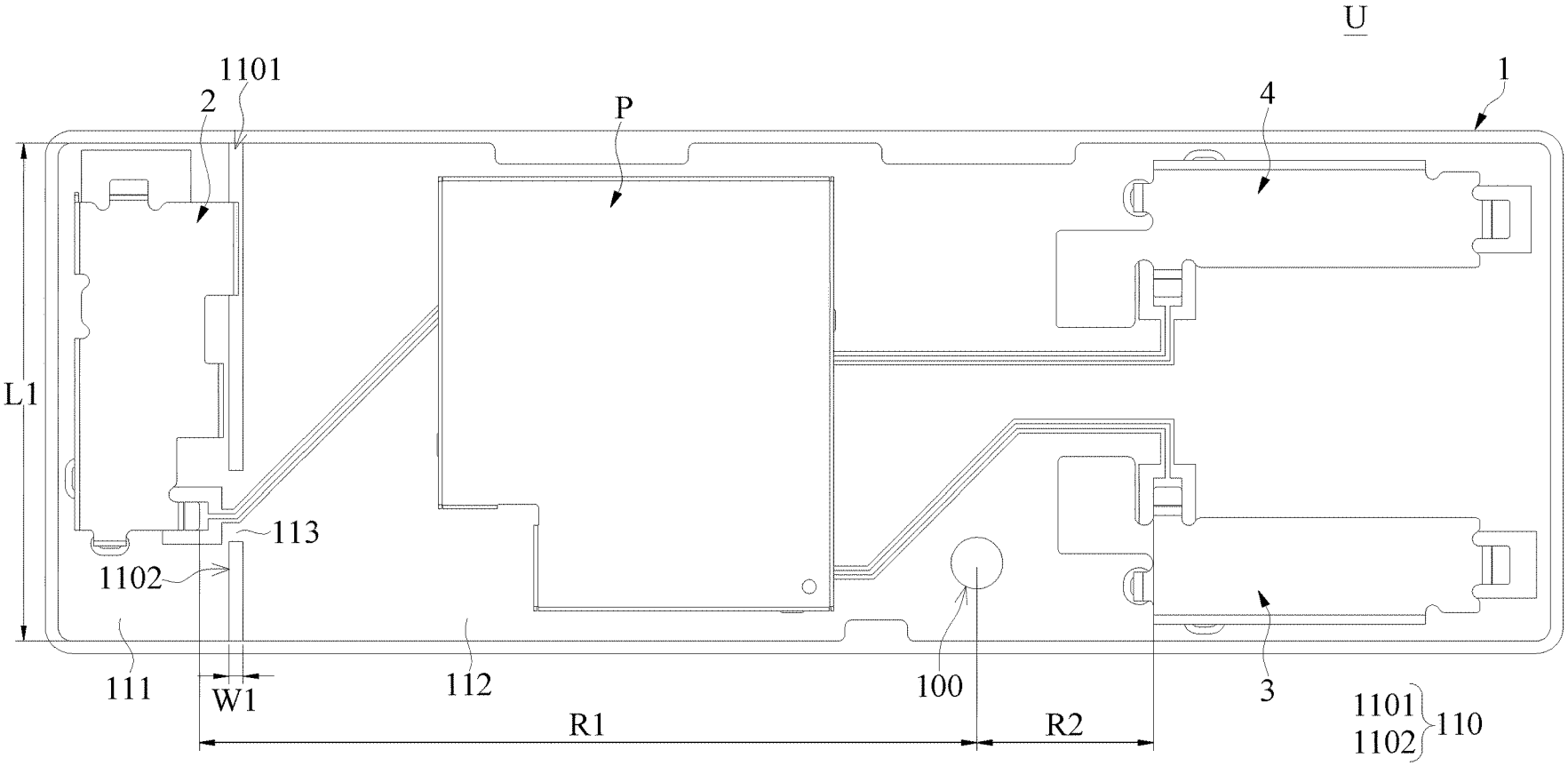
FIG. 8 illustrates a top view of the antenna module according to the first embodiment of the present disclosure.
Figure 9:
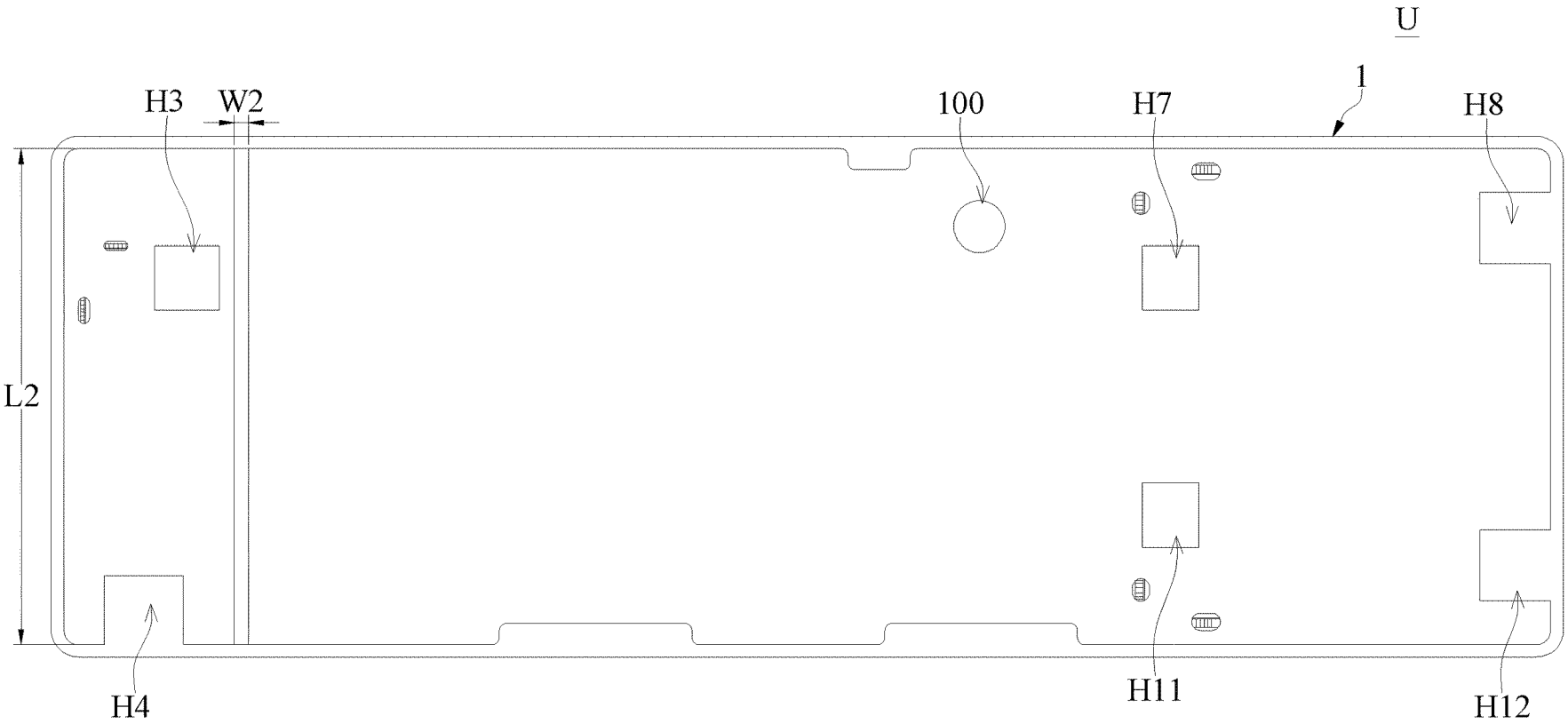
FIG. 9 illustrates a bottom view of the antenna module according to the first embodiment of the present disclosure.

References are made to FIG. 6 and FIG. 7, which are to be read in conjunction with FIG. 8 and FIG. 9. The first slot 110 has a first predetermined width W1, the second slot 120 has a second predetermined width W2. That is to say, a first predetermined width W1 is defined between the first ground portion 111 and the second ground portion 112, and a second predetermined width W2 is defined between the third ground portion 121 and the fourth ground portion 122. In the present disclosure, the first predetermined width W1 may be equal to the second predetermined width W2. In addition, the substrate body 10 has a predetermined thickness T. In addition, for example, the first predetermined width W1 and the second predetermined width W2 range from 0.2 millimeters to 5 millimeters. Preferably, the first predetermined width W1 and the second predetermined width W2 range from 0.5 millimeters to 2 millimeters. In addition, the predetermined thickness T ranges from 0.2 millimeters to 5 millimeters. Preferably, the predetermined thickness ranges from 0.2 millimeters to 2 millimeters. However, it should be noted that the present disclosure is not limited by the abovementioned examples. With this structure, in the present disclosure, that the vertical projections of the first slot section 1101 and the second slot section 1102 of the first slot 110 onto the substrate body 10 completely overlap with the vertical projection of the second slot 120 onto the substrate body 10 indicates that a situation in which the vertical projections of the first slot 110 and the second slot 120 onto the substrate body 10 are displaced with each other and do not partially overlap with each other does not exist.

The first slot 110 has a first predetermined length L1, and the second slot 120 has a second predetermined length L2. For example, the first predetermined length L1 may be greater than a quarter wavelength corresponding to the lowest frequency among an operating frequency band operated by the first antenna 2, the second predetermined length L2 may be greater than a quarter wavelength corresponding to the lowest frequency among an operating frequency band operated by the first antenna 2, and the wavelength abovementioned is related to a dielectric coefficient of the substrate 1. In other words, since the first antenna 2 provided in the present disclosure is able to operate in an operating frequency band having a frequency range from 2.4 GHz to 2.5 GHz, the first predetermined length L1 and the second predetermined length L2 should be calculated according to the operating frequency of 2.4 GHz. In addition, in one embodiment, by taking the dielectric coefficient of the substrate 1 into consideration, the wavelength may be calculated according to the following formula:

$$\lambda = \frac{C}{f * \sqrt{\varepsilon}}.$$

In the above formula, λ refers to the wavelength, c refers to the light speed, f refers to the operating frequency, ε refers to the dielectric coefficient of the substrate 1, and the present disclosure is exemplified by the dielectric coefficient of the substrate 1 being 4.3. With this structure, in the present disclosure, the first predetermined length L1 and the second predetermined length L2 are greater than 16 millimeters, which is not limited in the present disclosure. In addition, if a width of the substrate 1 is 35 millimeters, under a condition that the first slot 110 and the second slot 120 are completely empty on the substrate 1, the first predetermined length L1 and the second predetermined length L2 may be 35 millimeters. Therefore, in the present disclosure, the first predetermined length L1 and the second predetermined length L2 may range from 16 millimeters to 35 millimeters, which is not limited in the present disclosure.

It should be noted that, under a situation that the connecting portion 113 is disposed on the first ground layer 11, the first predetermined length L1 will be shorter due to the connecting portion 113 being disposed in first slot 110. Therefore, when the connecting portion 113 is disposed in first slot 110, the first predetermined length L1 may be calculated by obtaining a length that is calculated according to the lowest frequency among the operating frequency band operated by the first antenna 2, and then subtracting a length of the connecting portion 113 in the first slot 110 from the obtained length. In other words, under the situation that the connecting portion 113 is disposed on the first ground layer 11, the first predetermined length L1 is a sum of the lengths of the first slot section 1101 and the second slot section 1102.

Figure 10:
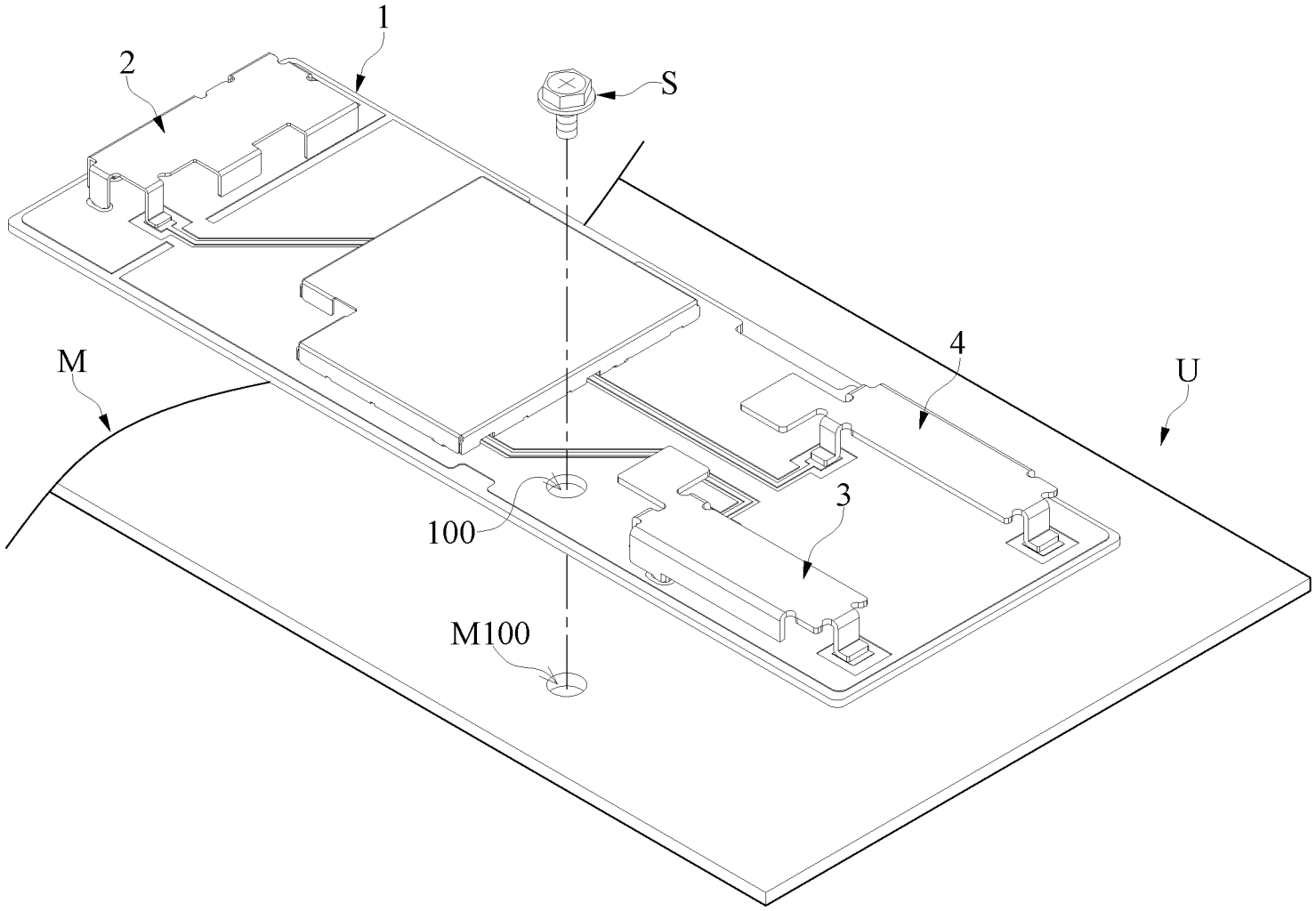
FIG. 10 is a schematic view showing a configuration of the antenna module according to the first embodiment of the present disclosure when applied to the mobile device.

Referring to FIG. 10, in the present disclosure, when the antenna module U needs to be disposed on a mobile device E, the substrate 1 further includes a fixing hole 100, and the fixing hole 100 penetrates the substrate body 10, the first ground layer 11 and the second ground layer 12. In the present disclosure, the fixing hole 100 is electrically connected between the first ground layer 11 and the second ground layer 12, that is, the fixing hole 100 may be regarded as a conductive via hole that is formed on the substrate 1. In addition, the fixing hole 100 is located between the first antenna 2 and the second antenna 3, and the second antenna 3 is located closer to the fixing hole 100 than the first antenna 2. Moreover, the fixing hole 100 penetrates the substrate body 10, the second ground portion 112 and the fourth ground portion 122, the second antenna 3 is located closer to the fixing hole 100 than the third antenna 4, and the fixing hole 100 is located close to the second conductive feeding portion 32 of the second antenna 3.

Referring to FIG. 1 and FIG. 10, the following describes a situation in which the antenna module U is applied to a mobile device E. In detail, the mobile device E includes a circuit board C, an antenna module U, a conductive metal sheet M and a conductive fixing element S. For example, the circuit board C may be a mother board of the mobile device E, the conductive metal sheet M may be a housing or a holder of the mobile device E, and the conductive fixing element S may be a metal screw. However, the present disclosure is not limited thereto. In addition, the conductive metal sheet M includes a positioning hole M100 corresponding to the fixing hole 100, the conductive fixing element S passes through the fixing hole 100 and is fixed within the positioning hole M100, so that the antenna module U is fixed with the conductive metal sheet M. In addition, since the fixing hole 100 is electrically connected to the first ground layer 11 and the second ground layer 12, the conductive fixing element S is electrically connected to the first ground layer 11, the second ground layer 12 and the conductive metal sheet M, such that an area of a reference ground of the antenna module U may be increased by adding the conductive metal sheet M to the mobile device E, and the isolation between the first antenna 2 and the second antenna 3 may be improved as well.

In continuance of the above, the first body 21 of the first antenna 2 and the second body 31 of the second antenna 3 of the antenna module U provided in the embodiment of the present disclosure are disposed on the non-clear section of the substrate 1. With this structure, when the vertical projection of the first antenna 2 onto substrate 1 at least partially or completely overlaps with a vertical projection of the conductive metal sheet M onto the substrate 1, and the vertical projection of the second antenna 3 onto the substrate 1 at least partially or completely overlaps with the vertical projection of the conductive metal sheet M onto the substrate 1, the first antenna 2 and the second antenna 3 are able to operate normally and keep performance at a certain level.

In FIG. 8, a first predetermined distance R1 is defined between the fixing hole 100 and the first conductive feeding portion 22 of the first antenna 2, a second predetermined distance R2 is defined between the fixing hole 100 and the second conductive feeding portion 32 of the second antenna 3, and the first predetermined distance R1 is smaller than the second predetermined distance R2. For example, the first predetermined distance R1 is approximately a quarter wavelength corresponding to the lowest frequency among an operating frequency band operated by the first antenna 2, the second predetermined distance R2 is approximately an one-eighth wavelength corresponding to the lowest frequency among an operating frequency band operated by the second antenna 3, which is not limited in the present disclosure.

Figure 11:
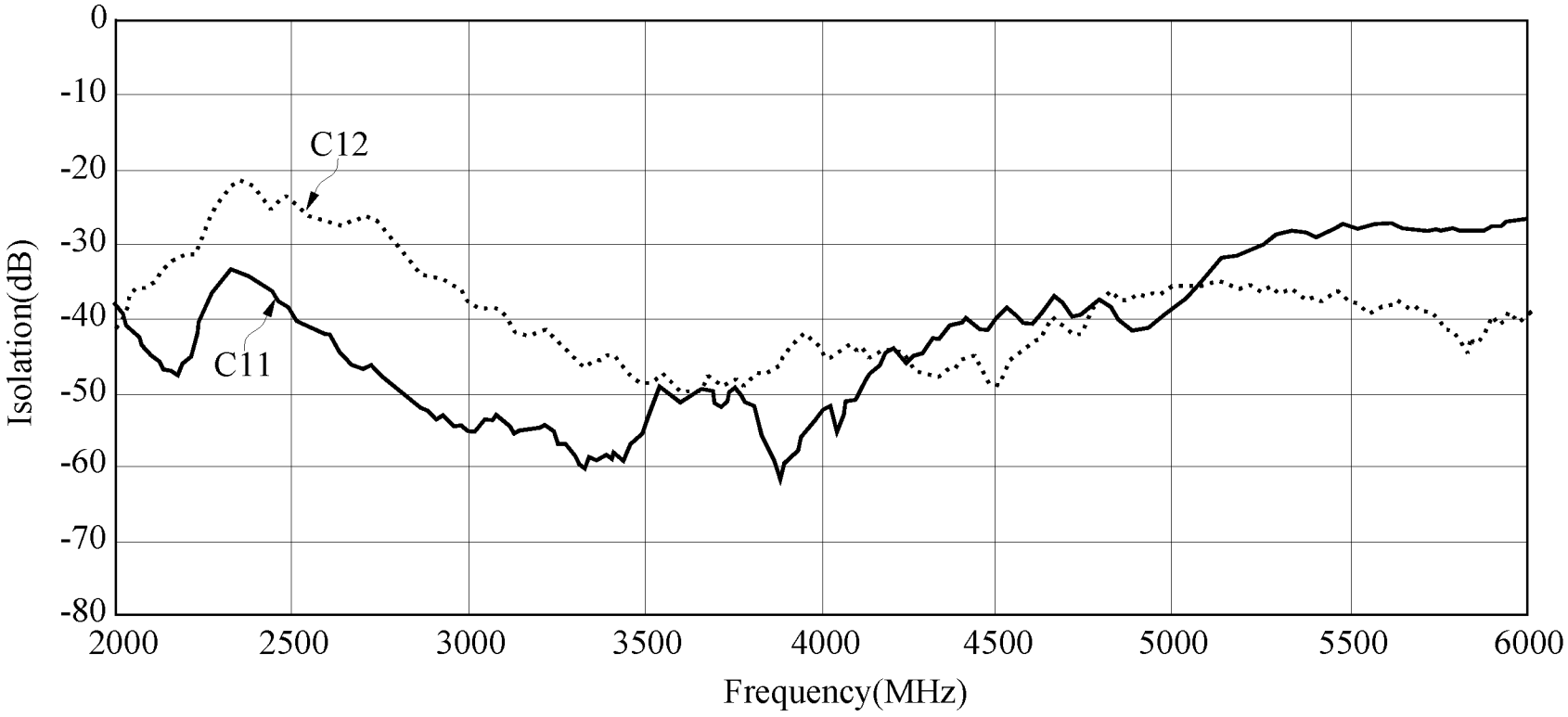
FIG. 11 illustrates a curve diagram showing isolation versus frequency for a first antenna and a second antenna of the antenna module according to the first embodiment of the present disclosure.
Figure 12:
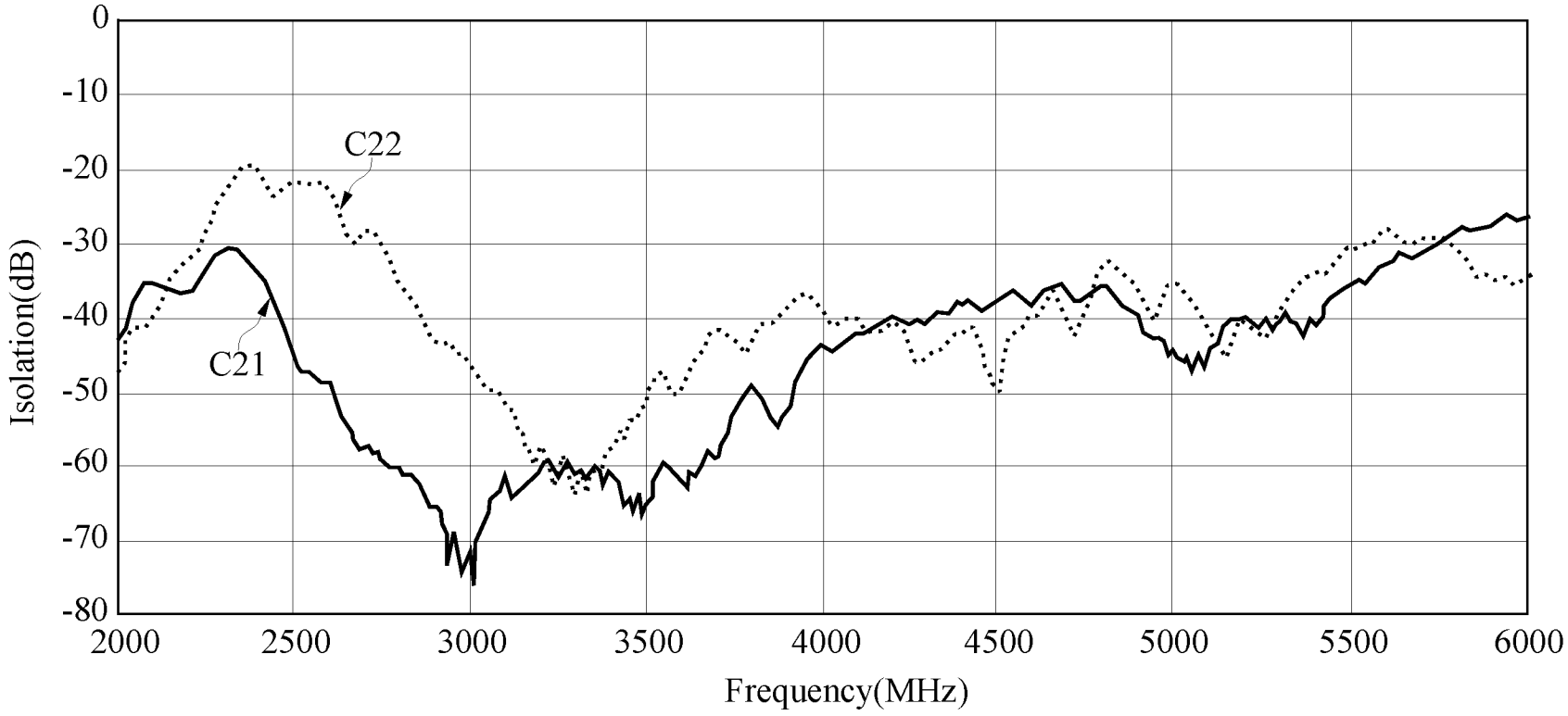
FIG. 12 illustrates a curve diagram showing isolation versus frequency for the first antenna and a third antenna of the antenna module according to the first embodiment of the present disclosure.

Referring to FIG. 11 and FIG. 12, a curve C11 shown in FIG. 11 refers to a curve showing isolation versus frequency between the first antenna 2 and the second antenna 3 when the first slot 110 and the second slot 120 are not formed on the substrate 1, and a curve C12 in FIG. 11 refers to a curve showing isolation versus frequency between the first antenna 2 and the second antenna 3 when the first slot 110 and the second slot 120 are formed on the substrate 1. In addition, a curve C21 in FIG. 12 refers to a curve showing isolation versus frequency between the first antenna 2 and the third antenna 4 when the first slot 110 and the second slot 120 are not formed on the substrate 1, and a curve C22 in FIG. 11 showing isolation versus frequency between the first antenna 2 and the third antenna 4 when the first slot 110 and the second slot 120 are formed on the substrate 1. With this structure, as can be seen from FIG. 11 and FIG. 12, the isolation between the first antenna 2 and the second antenna 3 and the isolation between the first antenna 2 and the third antenna 4 are improved when the first slot 110 and the second slot 120 are formed on the substrate 1.

Second Embodiment

Figure 13:
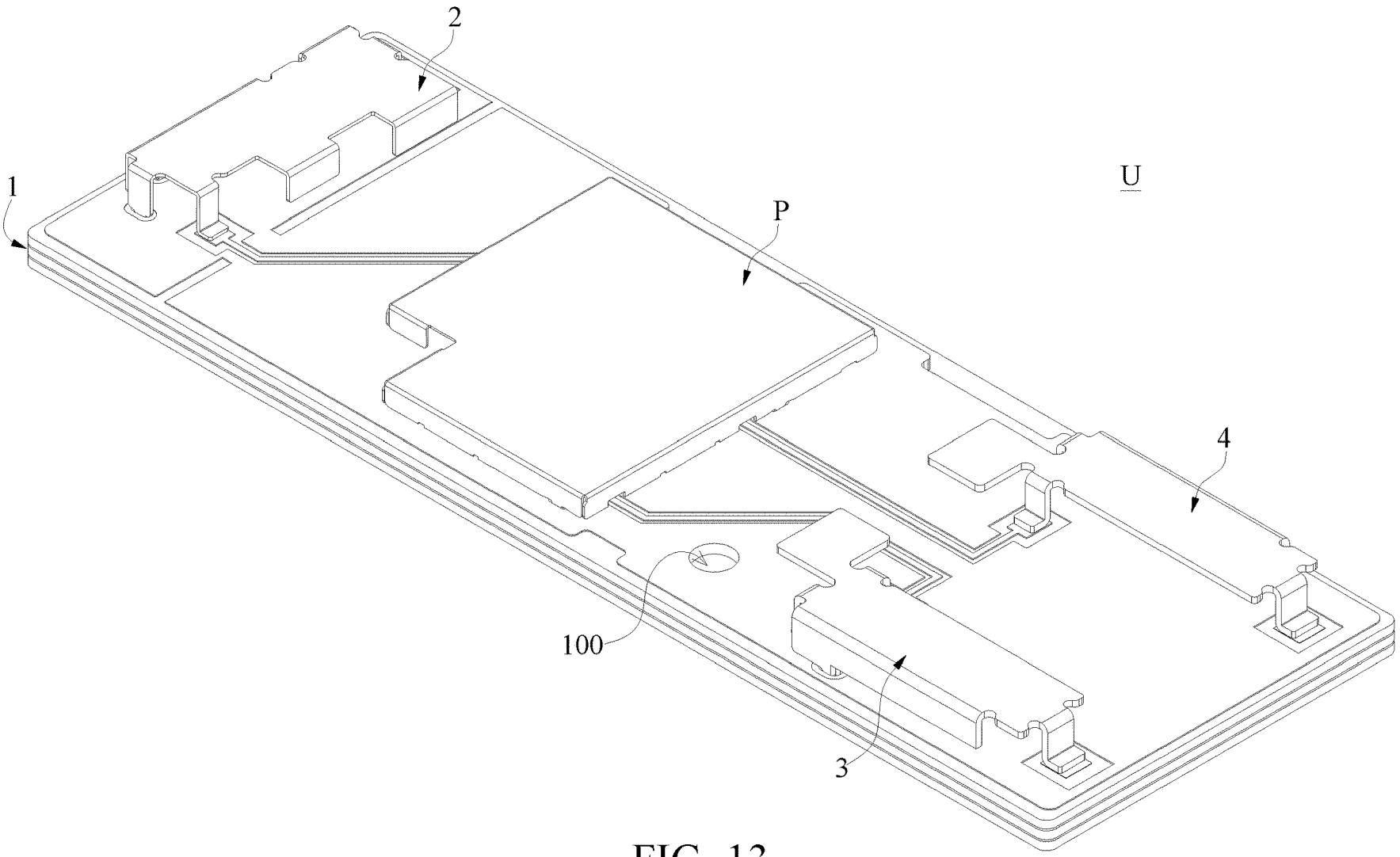
FIG. 13 illustrates an isometric view of an antenna module that is assembled according to a second embodiment of the present disclosure.
Figure 14:
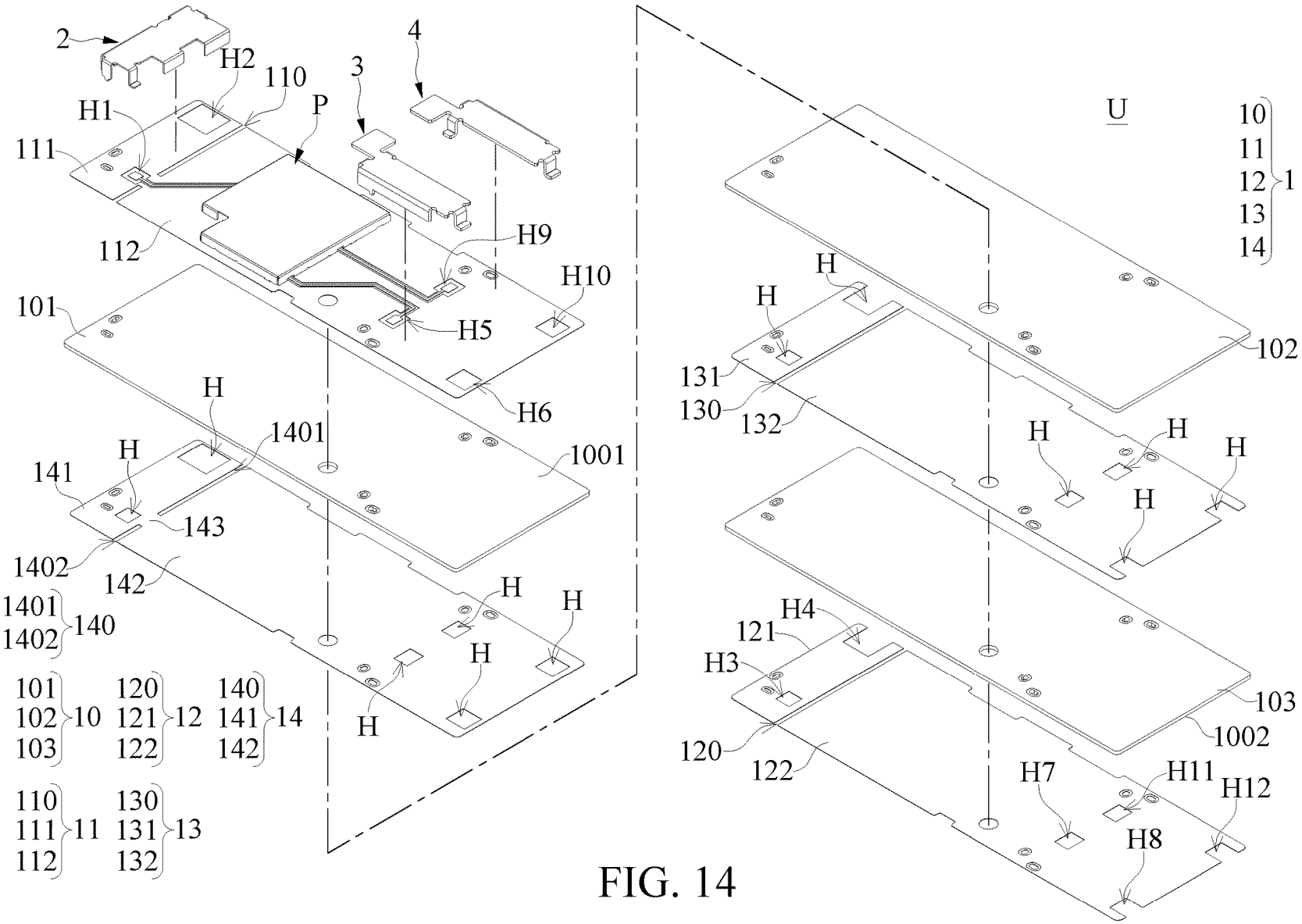
FIG. 14 illustrates an isometric view of the antenna module that is disassembled according to the second embodiment of the present disclosure.

Referring to FIG. 13 to FIG. 15, as can be seen by comparing FIG. 13 to FIG. 15 with FIG. 2 to FIG. 7, a difference between the second embodiment and the first embodiment is that the substrate 1 of the antenna module U provided in the second embodiment includes a plurality of ground layers, the substrate body 10 may include a plurality of carrier boards, and the plurality of ground layers may be respectively disposed on the corresponding plurality carrier boards. In other words, the first antenna 2 and the second antenna 3 of the antenna module U provided in the second embodiment may be disposed on a multi-layered board. In addition, note that other structures of the antenna module U provided in the second embodiment are similar to those of the first embodiment, and will not be reiterated herein.

In the second embodiment, the antenna module U includes a substrate 1, a first antenna 2 and a second antenna 3. For example, the substrate 1 may be a multi-layered board, the substrate 1 includes a substrate body 10 and a plurality of ground layers (e.g., at least one of the first ground layer 11, the second ground layer 12, the third ground layer 13 and the fourth ground layer 14), and the substrate body 10 may include a plurality of carrier boards (e.g., at least one of the first carrier board 101, the second carrier board 102 and the third carrier board 103). The plurality of ground layers may be disposed on the substrate body 10, and the plurality of ground layers are parallel to each other and disposed non-coplanar to each other. In addition, the plurality of ground layers are electrically connected to each other, and each of the plurality of ground layers includes two ground portions (e.g., at least two of the first ground portion 111, the second ground portion 112, the third ground portion 121, the fourth ground portion 122, the fifth ground portion 131, the sixth ground portion 132, the seventh ground portion 141 and the eighth ground portion 142) and a slot (e.g., at least one of the first slot 110, the second slot 120, the third slot 130 and the fourth slot 140) is disposed between the two ground portions. A plurality of vertical projections of the slot of each of the plurality of ground layers onto the substrate body 10 may form a plurality of projection regions, and each of the plurality of projection regions at least partially overlaps with each other; preferably, each of the plurality of projection regions completely overlaps with each other. In addition, a plurality of projection regions of a plurality of ground layers are located between the first antenna 2 and the second antenna 3, and the first antenna 2 is located closer to the plurality of projection regions than the second antenna 3.

In detail, the substrate 1 further includes a third ground layer 13, the third ground layer 13 is electrically connected to the second ground layer 12, the third ground layer 13 is disposed in the substrate body 10, and the third ground layer 13 is located between the first ground layer 11 and the second ground layer 12. In addition, the third ground layer 13 includes a fifth ground portion 131 electrically connected to the third ground portion 121, a sixth ground portion 132 electrically connected to the fourth ground portion 122 and a third slot 130 located between the fifth ground portion 131 and the sixth ground portion 132. The third slot 130 is located between the fifth ground portion 131 and the sixth ground portion 132, and the third slot 130 completely separates the fifth ground portion 131 from the sixth ground portion 132, such that the fifth ground portion 131 and the sixth ground portion 132 are completely separated from each other. In addition, a vertical projection of the third slot 130 onto the substrate body 10 at least partially overlaps with a vertical projection of the second slot 120 onto the substrate body 10. Furthermore, a vertical projection of the fifth ground portion 131 onto the substrate body 10 at least partially overlaps with a vertical projection of the third ground portion 121 onto the substrate body 10, and a vertical projection of the sixth ground portion 132 onto the substrate body 10 at least partially overlaps with a vertical projection of the fourth ground portion 122 onto the substrate body 10. In other words, the structure of the third ground layer 13 is similar to that of the second ground layer 12.

The substrate 1 further includes a fourth ground layer 14, the fourth ground layer 14 is electrically connected to the first ground layer 11, the fourth ground layer 14 is disposed in the substrate body 10, and the fourth ground layer 14 is located between the first ground layer 11 and the third ground layer 13. In other words, the third ground layer 13 and the fourth ground layer 14 are located between the first ground layer 11 and the second ground layer 12, the third ground layer 13 is located closer to the second ground layer 12 than the fourth ground layer 14, and the fourth ground layer 14 is located closer to the first ground layer 11 than the third ground layer 13. In addition, the fourth ground layer 14 includes a seventh ground portion 141 electrically connected to the first ground portion 111, an eighth ground portion 142 electrically connected to the second ground portion 112 and a fourth slot 140 located between the seventh ground portion 141 and the eighth ground portion 142, and a vertical projection of the fourth slot 140 onto the substrate body 10 at least partially overlaps with a vertical projection of the first slot 110 onto the substrate body 10. In addition, a vertical projection of the seventh ground portion 141 onto the substrate body 10 at least partially overlaps with a vertical projection of the first ground portion 111 onto the substrate body 10, and a vertical projection of the eighth ground portion 142 onto the substrate body 10 at least partially overlaps with a vertical projection of the second ground portion 112 onto the substrate body 10.

Moreover, in one embodiment, the fourth ground layer 14 further includes a connecting portion 143. The connecting portion 143 is electrically connected between the seventh ground portion 141 and the eighth ground portion 142, and is disposed on the fourth slot 140. A vertical projection of the connecting portion 143 of the fourth ground layer 14 onto the substrate body 10 at least partially overlaps with a vertical projection of the second slot 120 onto the substrate body 10, and the connecting portion 143 divides the fourth slot 140 into a first slot section 1401 and a second slot section 1402. In other words, the structure of the fourth ground layer 14 is similar to that of the first ground layer 11, and the first ground layer 11 and the fourth ground layer 14 respectively include a connecting portion (113 and 143). In addition, the vertical projection of the connecting portion 143 of the fourth ground layer 14 onto the substrate body 10 at least partially overlaps with a vertical projection of the first feeding element F1 disposed on the first ground layer 11 onto the substrate body 10. That is, the vertical projection of the first feeding element F1 located in the first groove G1 of the connecting portion 113 of the first ground layer 11 onto the substrate body 10 at least partially overlaps with the vertical projection of the connecting portion 143 of the fourth ground layer 14 onto the substrate body 10. With this structure, the impedance matching of the first antenna 2 may be easily adjusted by adjusting at least one of location and size of the connecting portion 143 configured to connect the seventh ground portion 141 and the eighth ground portion 142 in the fourth ground layer 14.

With this structure, preferably, in one embodiment of the present disclosure, when the substrate 1 is a multi-layered board, the structure of the ground layer (e.g., the fourth ground layer 14) that is closer to the first ground layer 11 is similar to that of the first ground layer 11, and the structure of the ground layer (e.g., the third ground layer 13) that is closer to the second ground layer 12 is similar to that of the second ground layer 12. That is, the vertical projection connecting portion 143 of the fourth ground layer 14 onto the substrate body 10 at least partially (or, preferably, completely) overlaps with the vertical projection of the connecting portion 113 of the first ground layer 11 onto the substrate body 10. In addition, as no connecting portion is disposed on the second ground layer 12 and the third ground layer 13, the third ground portion 121 and the fourth ground portion 122 are completely separated from each other by the second slot 120, and the fifth ground portion 131 and the sixth ground portion 132 are completely separated from each other by the third slot 130. In addition, it should be noted that the second embodiment is described by taking a four-layered board as the substrate 1 for example; however, the number of layers of the substrate 1 is not limited in the present disclosure.

Moreover, in the present disclosure, the vertical projections of the first slot section 1101 and the second slot section 1102 of the first slot 110 onto the substrate body 10 completely overlap with vertical projections of the first slot section 1401 and the second slot section 1402 of the fourth slot 140 onto the substrate body 10, and the vertical projection of the connecting portion 143 of the fourth ground layer 14 onto the substrate body 10 completely overlaps with the vertical projection of the connecting portion 113 of the first ground layer 11 onto the substrate body 10. In addition, the vertical projection of the second slot 120 onto the substrate body 10 completely overlaps with the vertical projection of the third slot 130 onto the substrate body 10. Furthermore, the vertical projections of the first slot section 1101 and the second slot section 1102 of the first slot 110 onto the substrate body 10 completely overlap with the vertical projection of the third slot 130 onto the substrate body 10, the vertical projections of the first slot section 1401 and the second slot section 1402 of the fourth slot 140 onto the substrate body 10 completely overlaps with the vertical projection of the second slot 120 onto the substrate body 10, and the vertical projections of the first slot section 1401 and the second slot section 1402 of the fourth slot 140 onto the substrate body 10 completely overlap with the vertical projection of the third slot 130 onto the substrate body 10. It should be noted that the abovementioned "completely overlap with" indicates that the predetermined widths (e.g., the first predetermined width W1 and the second predetermined width W2, while the predetermined widths of the third slot 130 and the fourth slot 140 are not shown in FIG. 14 to FIG. 15) of the first slot 110, the second slot 120, the third slot 130 and the fourth slot 140 are the same, and a situation in which a plurality of projection regions of each slot of a plurality of ground layers onto the substrate body 10 are displaced with each other and do not partially overlap with each other does not exist.

In particular, in the present disclosure, at least one of the third ground layer 13 and the fourth ground layer 14 further includes a plurality of hollow sections H corresponding to at least one of the first conductive feeding portion 22, the first support portion 24, the second conductive feeding portion 32, the second support portion 34, the third conductive feeding portion 42 and the third support portion 44 of the first antenna 2, the second antenna 3 and the third antenna 4, respectively. In addition, since the structures of the third ground layer 13 and the fourth ground layer 14 in the present disclosure are respectively similar to those of the first ground layer 13 and the second ground layer 14, locations and characteristics related to the plurality of hollow sections H formed in at least one of the third ground layer 13 and fourth ground layer 14 corresponding to the first antenna 2, the second antenna 3 and the third antenna 4 may be obtained by referring to above description, and will not be reiterated herein.

Beneficial Effects of the Embodiments

One of the beneficial effects of the present disclosure is that, in the mobile device E and the antenna module U thereof provided in the present disclosure utilizes, by virtue of "the vertical projection of the first slot 110 onto the substrate body 10 at least partially overlapping with the vertical projection of the second slot 120 onto the substrate body 10" and "the first slot 110 and the second slot 120 being located between the first antenna 2 and the second antenna 3, and the first antenna 2 being located closer to first slot 110 and the second slot 120 than the second antenna 3", the isolation between the first antenna 2 and the second antenna 3 is improved.

In detail, the present disclosure utilizes the technical solutions of "the vertical projection of the first body 21 onto the substrate body 10 at least partially overlapping with the vertical projection of the first ground portion 111 onto the substrate body 10", and "the vertical projection of the second body 31 onto the substrate body 10 at least partially overlapping with the vertical projection of the second ground portion 112 onto the substrate body 10", so that the antenna module U of the present disclosure is able to be fixed with the conductive metal sheet M by the fixing hole 100 and the conductive fixing element S. In addition, when the antenna module U is disposed on conductive metal sheet M, the first antenna 2 and the second antenna 3 are still able to operate normally and keep their performance at a certain level.

More specifically, the present disclosure utilizes the conductive fixing element S to electrically connect the first ground layer 11, the second ground layer 12 and the conductive metal sheet M, so that the conductive metal sheet M can be used to increase an area of a reference ground of the antenna module U, thereby improving the isolation between the first antenna 2 and the second antenna 3.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An antenna module, comprising:

a substrate including a substrate body, a first ground layer and a second ground layer, the substrate body having a first surface and a second surface corresponding to the first surface, the first ground layer being disposed on the first surface, the second ground layer being disposed on the second surface, and the first ground layer being electrically connected to the second ground layer, wherein the first ground layer includes a first slot, the second ground layer includes a second slot, and a vertical projection of the first slot onto the substrate body at least partially overlaps with a vertical projection of the second slot onto the substrate body;

a first antenna disposed on the substrate; and a second antenna disposed on the substrate;

wherein the first slot and the second slot are located between the first antenna and the second antenna, and the first antenna is located closer to the first slot and the second slot than the second antenna.

2. The antenna module of claim 1, wherein the first ground layer further includes a first ground portion and a second ground portion, the first slot being located between the first ground portion and the second ground portion, and the second ground layer further includes a third ground portion and a fourth ground portion, the second slot being located between the third ground portion and the fourth ground portion; wherein a vertical projection of the first ground portion onto the substrate body at least partially overlaps with a vertical projection of the third ground portion onto the substrate body, and a vertical projection of the second ground portion onto the substrate body at least partially overlaps with a vertical projection of the fourth ground portion onto the substrate body.

3. The antenna module of claim 2, wherein a vertical projection of the first antenna onto the substrate body at least partially overlaps with the vertical projection of the first ground portion onto the substrate body, and a vertical projection of the second antenna onto the substrate body at least partially overlaps with the vertical projection of the second ground portion onto the substrate body.

4. The antenna module of claim 2, wherein the first slot has a first predetermined width, and the second slot has a second predetermined width, the first predetermined width and the second predetermined width ranging from 0.2 millimeters to 5 millimeters; wherein the substrate body includes a predetermined thickness, the predetermined thickness ranging from 0.2 millimeters to 5 millimeters.

5. The antenna module of claim 2, wherein the first slot has a first predetermined length, and the second slot has a second predetermined length, the first predetermined length being greater than a quarter wavelength of a lowest frequency among an operating frequency band operated by the first antenna, the second predetermined length being greater than a quarter wavelength of a lowest frequency among an operating frequency band operated by the first antenna, and the quarter wavelength of the lowest frequency among the operating frequency band relating to a dielectric coefficient of the substrate.

6. The antenna module of claim 2, wherein the first ground layer further includes a connecting portion, the first slot having a first slot section and a second slot section, the connecting portion being disposed on the substrate body, the connecting portion being electrically connected between the first ground portion and the second ground portion and being disposed between the first slot section and the second slot section, and a vertical projection of the connecting portion onto the substrate body at least partially overlapping with a vertical projection of the second slot onto the substrate body.

7. The antenna module of claim 6, wherein vertical projections of the first slot section and the second slot section of the first slot onto the substrate body completely overlap with the vertical projection of the second slot onto the substrate body, and the vertical projection of the connecting portion onto the substrate body completely overlaps with the vertical projection of the second slot onto the substrate body.

8. The antenna module of claim 2, wherein the first ground layer further includes a connecting portion, the connecting portion being disposed on the substrate body, the connecting portion being electrically connected between the first ground portion and the second ground portion, and a vertical projection of the connecting portion onto the substrate body at least partially overlapping with a vertical projection of the second slot onto the substrate body.

9. The antenna module of claim 2, wherein the first antenna includes a first body, a first feeding portion electrically connected to the first body, and a first conductive grounding portion electrically connected between the first body and the first ground layer; wherein the second antenna includes a second body, a second conductive feeding portion electrically connected to the second body, and a second conductive grounding portion electrically connected between the second body and the first ground layer; wherein a vertical projection of the first body onto the substrate body at least partially overlaps with a vertical projection of the first ground portion onto the substrate body, and a vertical projection of the second body onto the substrate body at least partially overlaps with a vertical projection of the second ground portion onto the substrate body.

10. The antenna module of claim 9, wherein the first antenna further includes a first support portion abutting against the substrate body, and the second antenna further includes a second support portion abutting against the substrate body; wherein the first ground layer further includes a first hollow section corresponding to the first conductive feeding portion and a second hollow section corresponding to the first support portion, and the second ground layer further includes a third hollow section corresponding to the first conductive feeding portion and a fourth hollow section corresponding to the first support portion, a vertical projection of the first hollow section onto the substrate body at least partially overlapping with a vertical projection of the third hollow section onto the substrate body, and a vertical projection of the second hollow section onto the substrate body at least partially overlapping with a vertical projection of the fourth hollow section onto the substrate body; wherein the first ground layer further includes a fifth hollow section corresponding to the second conductive feeding portion and a sixth hollow section corresponding to the second support portion, and the second ground layer further includes a seventh hollow section corresponding to the second conductive feeding portion and an eighth hollow section corresponding to the second support portion, a vertical projection of the fifth hollow section onto the substrate body at least partially overlapping with a vertical projection of the seventh hollow section onto the substrate body, and a vertical projection of the sixth hollow section onto the substrate body at least partially overlapping with a vertical projection of the eighth hollow section onto the substrate body.

11. The antenna module of claim 1, wherein the substrate further includes a third ground layer, the third ground layer being electrically connected to the second ground layer, and the third ground layer being disposed in the substrate body, and being located between the first ground layer and the second ground layer; wherein the third ground layer includes a fifth ground portion electrically connected to the third ground portion, a sixth ground portion electrically connected to the fourth ground portion, and a third slot located between the fifth ground portion and the sixth ground portion, a vertical projection of the third slot onto the substrate body at least partially overlapping with a vertical projection of the second slot onto the substrate body; wherein a vertical projection of the fifth ground portion onto the substrate body at least partially overlaps with a vertical projection of the third ground portion onto the substrate body, and a vertical projection of the sixth ground portion onto the substrate body at least partially overlaps with a vertical projection of the fourth ground portion onto the substrate body.

12. The antenna module of claim 11, wherein the substrate further includes a fourth ground layer, the fourth ground layer being electrically connected to the first ground layer, and the fourth ground layer being disposed in the substrate body, and being located between the first ground layer and the third ground layer; wherein the fourth ground layer includes a seventh ground portion electrically connected to the first ground portion, an eighth ground portion electrically connected to the second ground portion, and a fourth slot located between the seventh ground portion and the eighth ground portion, a vertical projection of the fourth slot onto the substrate body at least partially overlapping with a vertical projection of the first slot onto the substrate body; wherein a vertical projection of the seventh ground portion onto the substrate body at least partially overlaps with a vertical projection of the first ground portion onto the substrate body, and a vertical projection of the eighth ground portion onto the substrate body at least partially overlaps with a vertical projection of the second ground portion onto the substrate body.

13. The antenna module of claim 12, wherein the fourth ground layer further includes a connecting portion, the fourth slot having a first slot section and a second slot section, the connecting portion being disposed on the substrate body, the connecting portion being electrically connected between the seventh ground portion and the eighth ground portion and being disposed between the first slot section and the second slot section, and a vertical projection of the connecting portion onto the substrate body at least partially overlapping with the vertical projection of the second slot onto the substrate body.

14. The antenna module of claim 1, further comprising a third antenna, the third antenna being disposed on the substrate, the third antenna including a third conductive feeding portion and a third conductive grounding portion electrically connected to the first ground layer, wherein the first slot and the second slot are located between the first antenna and the third antenna, and the first antenna is located closer to the first slot and the second slot than the third antenna.

15. The antenna module of claim 14, further comprising a signal processing circuit, a first feeding element and a second feeding element, wherein the signal processing circuit is disposed on the substrate, the first antenna is electrically connected to the signal processing circuit, and the second antenna is electrically connected to the signal processing circuit; wherein the first feeding element is electrically connected between the first antenna and the signal processing circuit, and the second feeding element is electrically connected between the second antenna and the signal processing circuit; wherein the first antenna is a Bluetooth® antenna, and the second antenna and the third antenna are Wi-Fi antennas, the first antenna being able to operate in an operating frequency band having a frequency range from 2.4 GHz to 2.5 GHz, and the second antenna and the third antenna each being able to operate in another operating frequency band having a frequency range from 2.4 GHz to 2.5 GHz.

16. The antenna module of claim 1, wherein the substrate further has a fixing hole, the fixing hole penetrating the substrate body, the first ground layer and the second ground layer, the fixing hole being located between the first antenna and the second antenna, and the second antenna being located closer to the fixing hole than the first antenna.

17. A mobile device, comprising:

a circuit board;

an antenna module electrically connected to the circuit board, the antenna module including a substrate, a first antenna and a second antenna, wherein the substrate includes a substrate body, a first ground layer, a second ground layer and a fixing hole, the substrate body having a first surface and a second surface corresponding to the first surface, the first ground layer being disposed on the first surface, the second ground layer being disposed on the second surface, and the first ground layer being electrically connected to the second ground layer; wherein the fixing hole penetrates the substrate body, the first ground layer and the second ground layer, the first ground layer includes a first slot, and the second ground layer includes a second slot, a vertical projection of the first slot onto the substrate body at least partially overlapping with a vertical projection of the second slot onto the substrate body, and wherein the first antenna and the second antenna are disposed on the substrate, the first slot and the second slot are located between the first antenna and the second antenna, and the first antenna is located closer to the first slot and the second slot than the second antenna;

a conductive metal sheet including a positioning hole corresponding to the fixing hole; and a conductive fixing element passing through the fixing hole and being fixed within the positioning hole, the conductive fixing element being electrically connected to the first ground layer and the conductive metal sheet.

18. The mobile device of claim 17, wherein the fixing hole is located between the first antenna and the second antenna, and the second antenna is located closer to the fixing hole than the first antenna.

19. The mobile device of claim 18, wherein the antenna module further includes a signal processing circuit, the signal processing circuit being disposed on the substrate and electrically connected to the circuit board; wherein the first antenna is electrically connected to the signal processing circuit, and the second antenna is electrically connected to the signal processing circuit; wherein the first antenna is a Bluetooth® antenna, and the second antenna is a Wi-Fi antenna.

20. An antenna module, comprising:

a substrate including a substrate body and a plurality of ground layers, the plurality of the ground layer being disposed on the substrate body, and the plurality of the ground layers being arranged parallel to each other and being disposed non-coplanar to each other, wherein the plurality of the ground layers are electrically connected to each other, each of the plurality of ground layers includes a slot and two ground portions, and a plurality of vertical projections of the slots of the plurality of ground layers onto the substrate body form a plurality of projection regions, each of the plurality of projection regions at least partially overlapping with each other;

a first antenna disposed on the substrate; and a second antenna disposed on the substrate;

wherein the plurality of projection regions are located between the first antenna and the second antenna, and the first antenna is located closer to the plurality of projection regions than the second antenna.

* * * * *